US011719506B2

(12) United States Patent
Haas

(10) Patent No.: US 11,719,506 B2
(45) Date of Patent: Aug. 8, 2023

(54) BOWSTRING RELEASE

(71) Applicant: FERADYNE OUTDOORS, LLC, Superior, WI (US)

(72) Inventor: Matthew Peter Haas, Duluth, MN (US)

(73) Assignee: FERADYNE OUTDOORS, LLC, Superior, WI (US)

( * ) Notice: Subject to any disclaimer, the term of this patent is extended or adjusted under 35 U.S.C. 154(b) by 9 days.

(21) Appl. No.: 17/613,879

(22) PCT Filed: May 19, 2020

(86) PCT No.: PCT/US2020/033661
§ 371 (c)(1),
(2) Date: Nov. 23, 2021

(87) PCT Pub. No.: WO2020/236849
PCT Pub. Date: Nov. 26, 2020

(65) Prior Publication Data

US 2022/0252373 A1 Aug. 11, 2022

Related U.S. Application Data

(60) Provisional application No. 62/932,741, filed on Nov. 8, 2019, provisional application No. 62/851,967, filed on May 23, 2019.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 5,941,225 A * 8/1999 Tentler ..... F41B 5/1469 124/35.2
6,058,920 A * 5/2000 Tentler ..... F41B 5/1469 124/35.2
6,925,995 B1 8/2005 McConnell et al.
7,581,536 B2 * 9/2009 Porter ..... F41B 5/1469 124/35.2
8,869,781 B2 * 10/2014 Jones ..... F41B 5/1469 124/90

(Continued)

FOREIGN PATENT DOCUMENTS

KR 10-2018-0012523 A 2/2018

OTHER PUBLICATIONS

International Search Report and Written Opinion, issued by the ISA/KR Korean Intellectual Property Office, regarding corresponding patent application Serial No. PCT/US2020/033661; dated Aug. 31, 2020; 13 pages.

*Primary Examiner* — John A Ricci
(74) *Attorney, Agent, or Firm* — Greenberg Traurig, LLP

(57) ABSTRACT

A bowstring release includes a body, a jaw, a trigger, first and second biasing elements, and a back tension adjustment apparatus having a sheath, a tension adjustment rod, a tension adjustment knob, and a back tension biasing element. Moving the jaw into a channel of the body cocks the release. Pulling the trigger releases the bowstring.

20 Claims, 22 Drawing Sheets

(56) References Cited

U.S. PATENT DOCUMENTS

| | | | | |
|---|---|---|---|---|
| 8,997,729 | B1 * | 4/2015 | Gillig | F41B 5/1469<br>124/35.2 |
| 2003/0019488 | A1 | 1/2003 | Eckert et al. | |
| 2009/0250047 | A1 | 10/2009 | Jones | |
| 2012/0285431 | A1 | 11/2012 | Sommers et al. | |

* cited by examiner

BOWSTRING RELEASE

CROSS-REFERENCE TO RELATED APPLICATIONS

This application is a national stage of International Patent Application: PCT/US2020/033661, filed on May 19, 2020; and claims the benefit of U.S. Provisional Patent Application No. 62/932,741, filed Nov. 8, 2019, and U.S. Provisional Patent Application No. 62/851,967, filed May 23, 2019, which are herein incorporated by reference in their entirety.

STATEMENT REGARDING FEDERALLY SPONSORED RESEARCH OR DEVELOPMENT

Not applicable.

TECHNICAL FIELD

The instant disclosure relates to a release for drawing and releasing a bowstring.

BACKGROUND

Conventional bows are difficult, if not nearly impossible, to draw using only an archer's fingers. An archery release is a device that aids the archer draw the bowstring and release the arrow attached to the bowstring. Some embodiments of archery releases include a hook for pulling the bowstring, and a trigger operatively or functionally coupled to the hook whereby "pulling" or operating or activating the trigger causes the hook to release the drawn bowstring. Some archery releases include a handle for assisting the archer in drawing the bowstring.

While conventional archery releases are relatively easy to use, many archers encounter and/or have to contend with "target panic". "Target panic" is a psychological, and perhaps neurological, condition experienced or encountered by both competitive and recreational archers in the form of "fear of failure" and high levels of anxiety when the arrow is brought onto the target. Typically, "target panic" sets in immediately prior to "pulling" the trigger because subliminally the archer knows that s/he is about to release the bowstring. To remedy this, i.e., to overcome "target panic", archers are often taught to "pull through" the release and allow it to "go off", i.e., release the bowstring, on its own rather than by "pulling" the trigger.

U.S. Pat. No. 5,357,939 discloses a bow string release having a trigger mechanism which may be selectively operated in a push to fire or pull to fire manner. The release includes a strap mechanism having a continuous loop wrist strap facilitating quick attachment and detachment of the strap to the wrist. The distance between the release and the strap is adjustable to permit adaptation of the release and strap to varying size hands. The sear mechanism in the release is adapted to pivot relative to the release body without the use of spherical bearing elements. The pull force of the trigger is adjustable in a direction orthogonal to the trigger travel. The head of the release is both rotatable and tiltable relative to the strap.

U.S. Pat. No. 5,564,407 discloses a caliper type bow string release having a reversible trigger which is operable selectively in either the push fire mode or the pull fire mode. The caliper jaws of the release include automatic alignment and locking features. Movement of the string into the release mechanism engages the automatic locking mechanism and closes the release into a string retaining position until the release is fired by activation of the trigger. A complex cam surface is provided on the actuator for permitting incremental linear adjustment of the trigger force.

U.S. Pat. No. 5,582,158 discloses a caliper type bow string release having a rocking trigger and caliper jaws with automatic alignment and locking features, whereby movement of the string into the release mechanism engages the automatic locking mechanism and closes the release into a string retaining position until the release is fired by activation of the trigger. A complex cam surface is provided on the actuator for permitting incremental linear adjustment of the trigger force. The release head is universally adjustable relative to a wrist strap or similar mounting.

U.S. Pat. No. 6,763,819 discloses a bow string release for engaging and releasing a bow string, comprising opposing jaws, a trigger, a housing, a jaw roller and a plurality of pins. The opposing jaws and the trigger are coupled to the housing by pins, and the jaw roller, coupled to the trigger, allows the opposing jaws to an open condition when the trigger is in a pulled position. The bow string release is adapted to minimize "loading up" of trigger force required to pull the trigger at full draw of a bow. Further the bow string release is adapted to release the bow string at a trigger pull force of equal to or less than 9 ounces when an effective draw weight of the bow is equal to or more than 15 pounds.

U.S. Pat. No. 7,240,672 discloses an adjustable trigger pressure archery release including a bayonet mounted trigger utilizing an actuator ramp to reduce trigger travel. The caliper jaws and cam profile combine to create an automatic closing action to close the release, whereby rearward pulling or squeezing movement of the trigger engages the caliper jaws to an open bow string or string loop apparatus receiving condition, and relaxing or releasing movement of the trigger closes the caliper jaws into a string retaining position. The release includes an independent mechanism for permitting adjustment of the trigger pressure force, without affecting trigger travel including frictional means of maintaining selected setting. The release head is universally adjustable or lockable relative to a wrist strap or similar mounting.

U.S. Pat. No. 7,314,045 discloses a string release for providing accurate release of a tensioned bow string. The release has a pair of jaws which are retained and controlled by a pivot ball and a jaw cup. The pivot ball is mounted on a shaft which is attached to an inner race which is in turn contained within a ball housing. The inner race is positioned such that it may slide laterally within the ball housing. In the closed position, a number of balls retain the inner race in an aft position relative to the jaws. A trigger mechanism actuates a locking sleeve which allows the balls to move such that the inner race may slide forward, thereby allowing the jaw to open. The release further includes a trigger force adjusting mechanism that allows adjustment of the force required to activate the trigger mechanism.

U.S. Pat. No. 8,276,575 discloses an archery bowstring release having a pair of bowstring-gripping jaws actuatable by a trigger, with the trigger and jaws both being pivotally linked to the housing. A cam situated within the housing has a trigger cam pivot which translates and rotates with respect to the trigger, such that the cam is urged by actuation of the trigger to open and close the jaws. The forward part of the housing bearing the jaws may be rotatable with respect to the rear part of the housing, such that the plane in which the jaws move can be rotated with respect to the plane in which the trigger moves.

U.S. Pat. No. 8,997,729 discloses an archery bowstring release having a single jaw for retaining a bowstring within a bowstring hook, in contrast to dual jaw pincer-type releases. The bowstring hook is situated on a release head which bears a trigger for actuating the jaw and releasing the bowstring, and a release body extends between the release head and a release mount (which can connect the bowstring release to a wrist strap, glove, or other anchor affixed to the user's body). The release head and body are pivotally joined, and when the release is ready to fire, the central axis of the release body, and at least the rear of the release head, have central longitudinal axes which are aligned with the notch in the bowstring hook, and are thus aligned with the bowstring, and are parallel to or in line with the arrow. The release therefore has a comfortable, natural, and intuitive feel during operation.

U.S. Pat. Application Pub. No. 2016/0258708 discloses systems and methods that enable archers to select and interchange various styles of interchangeable triggers, including one-finger and two-finger triggers, for use in an archery release. The interchangeable triggers enable an archer to customize the archery release with regard to increasing the archer's comfort and improving the archer's shooting performance.

U.S. Pat. No. 9,891,019 discloses an archery release configured to eliminate, or at least minimize, vibrations and/or noise generated when a drawn bowstring is released from a pre-shoot position. The archery release includes a substrate subassembly and an overmolding material bonded to each other. The overmolding material is configured to absorb and eliminate, or at least minimize the vibrations and/or noise. The archery release also includes a trigger, a release mechanism, and a latching assembly extending into a hollow interior of a handle of the archery release. Within the handle, the latching assembly is operably coupled with the trigger and with the release mechanism. Vibrations and/or noise is eliminated, or at least minimized, by placing the overmolding material at locations whereat one or more components of the trigger, the latching assembly, and the release mechanism strike or engage the overmolding material instead of the substrate subassembly.

U.S. Pat. Application Pub. No. 2019/0265000 discloses a bowstring release having a handle, a jaw, and a sear. The jaw is configured for drawing and releasing the bowstring. The sear includes a plurality of settings for adjusting the rotation of the handle at which the jaw releases the bowstring. While the bowstring is in the drawn configuration, the jaw and the sear are slidingly coupled and the jaw slides along a surface of the sear while the release is rotated. The bowstring is released when the jaw and the sear de-couple.

SUMMARY

A non-limiting exemplary embodiment of a bowstring release includes a body, a jaw, a trigger, and first and second biasing elements. In some exemplary embodiments, the body is defined at least in part by a first and a second end, a channel extending between the first and second ends, and spaced apart opposing walls at the second end. In certain exemplary embodiments, the jaw is defined at least in part by first and second ends and spaced apart opposing walls at the second end. In some embodiments, at least a portion of the jaw is disposed within the channel of the body, the second end of the jaw is disposed between the opposing walls of the body, and the jaw is coupled to the body. In some exemplary embodiments, the trigger is disposed between and coupled to the opposing walls of the body and includes an edge slidably engaged with a surface of the jaw. In certain exemplary embodiments, the first biasing element is disposed between the body and the jaw. In some exemplary embodiments, the second biasing element is disposed between the trigger and the jaw. In certain exemplary embodiments, moving the jaw into the channel of the body cocks the release.

In a non-limiting exemplary embodiment, the bowstring release includes a back tension adjustment apparatus. A non-limiting exemplary embodiment, the back tension adjustment apparatus includes a sheath, a tension adjustment rod, a tension adjustment knob, and a back tension biasing element. In some exemplary embodiments, the sheath is defined at least in part by a first section having opposing walls, a slot in each opposing wall aligned with each other, and a second section. In certain exemplary embodiments, the tension adjustment rod includes a first section extending into at least a portion of the body of the release and a second section extending into the second section of the sheath. In certain exemplary embodiments, the tension adjustment knob is coupled to the tension adjustment rod. In some exemplary embodiments, the back tension biasing element is disposed about the second section of the tension adjustment rod within the second section of the sheath, and extends between an interior end of the second section of the sheath and the tension adjustment knob. In certain embodiments, at least a portion of the body of the release is disposed between the opposing walls of the sheath. In some embodiments, the first section of the sheath is in sliding engagement with the body of the release. In certain embodiments, the second section of the sheath is in sliding engagement with the second section of the tension adjustment rod.

DETAILED DESCRIPTION

One or more non-limiting exemplary embodiments are disclosed herein with reference to the accompanying drawings, wherein like numerals indicate like, but not necessarily identical, elements. It should be clearly understood that the embodiments described with reference to the drawings are merely exemplary in that any one or more of them may be implemented in alternative manner as may become apparent to a person of ordinary skills. The figures are not necessarily to scale. Specific structural and/or functional features and details disclosed herein are not to be construed as limiting but should rather be treated as a basis for teaching one of ordinary skills. There is no intent, implied or otherwise, to limit the disclosure in any way, shape or form to the embodiments illustrated and described herein. Accordingly, all variants for providing structures and/or functionalities similar to those described herein for the exemplary embodiments are considered as being within the metes and bounds of the instant disclosure.

Figure 1A:
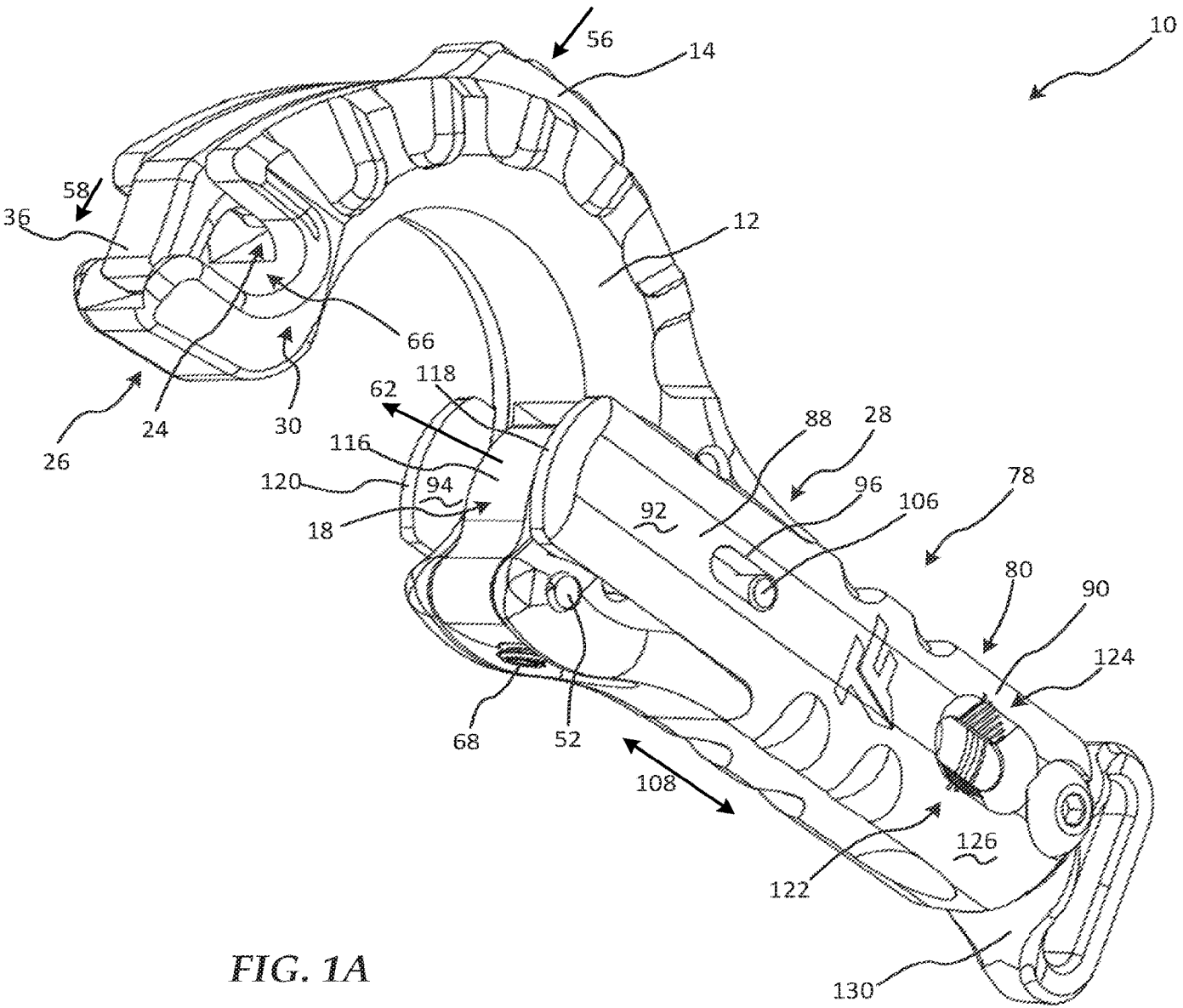
FIGS. 1A and 1B are perspective views of a non-limiting exemplary embodiment of a bowstring release.
Figure 1B:
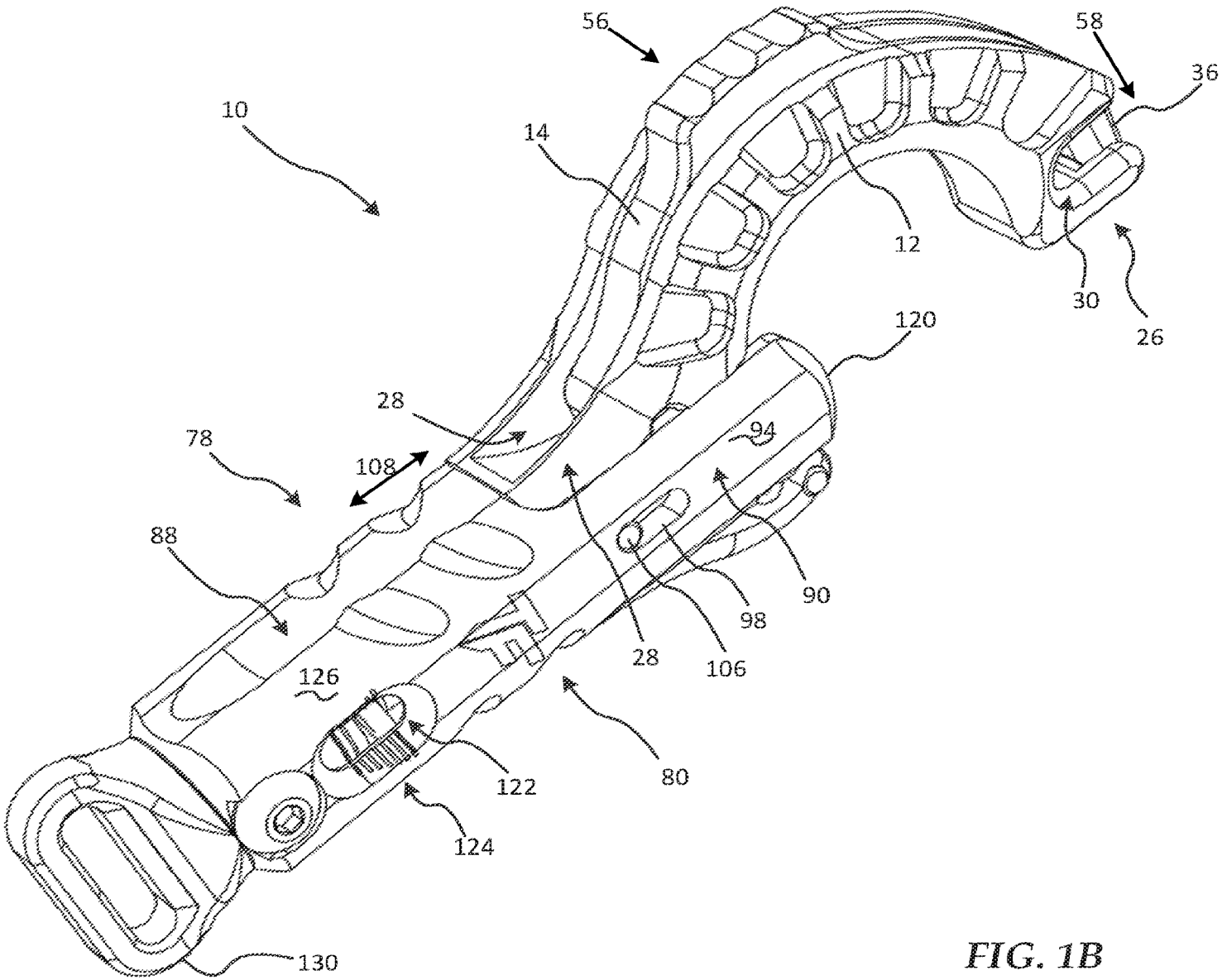
Figure 2:
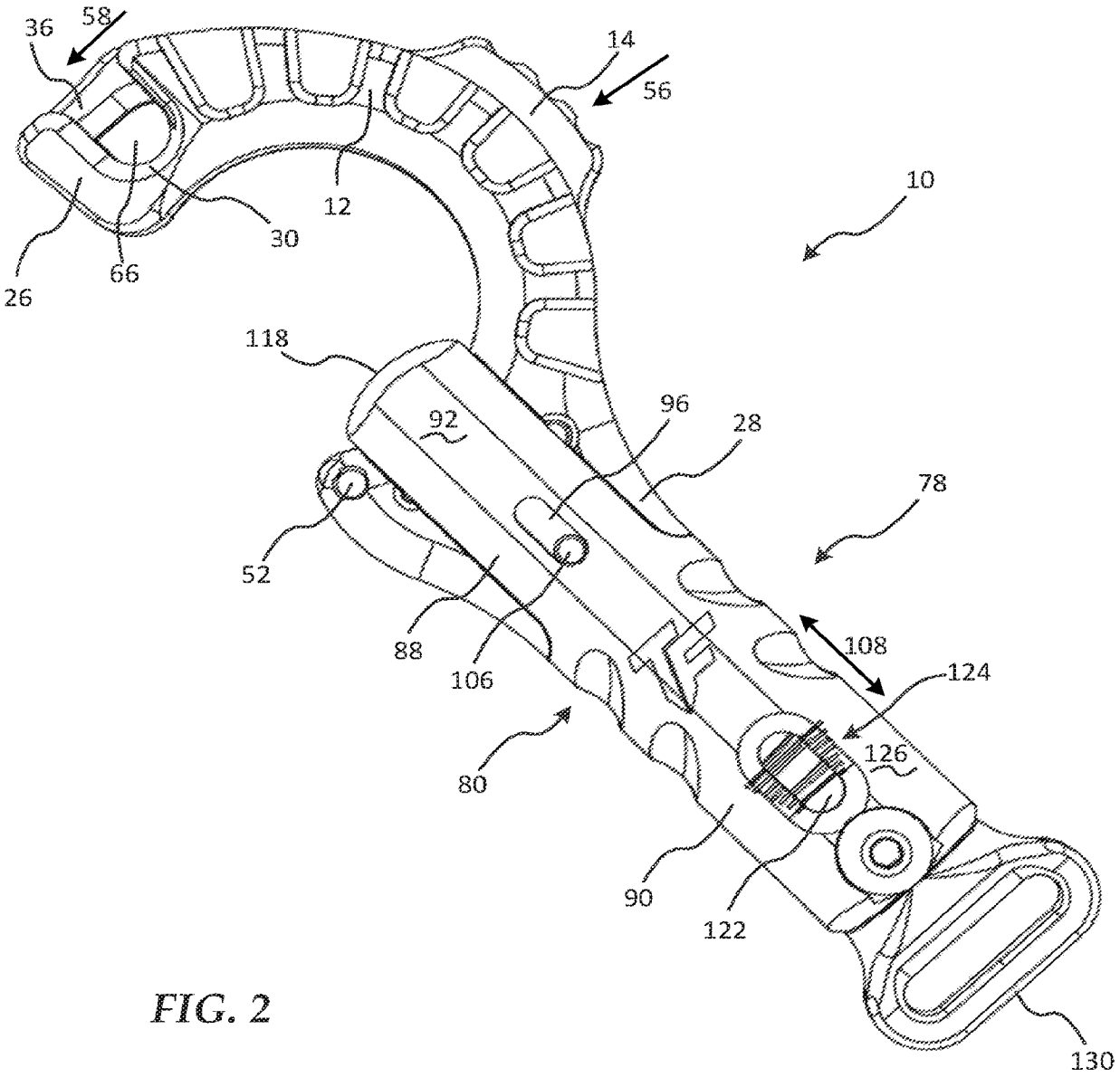
FIG. 2 is a side view of the bowstring release illustrated in FIGS. 1A and 1B.
Figure 3:
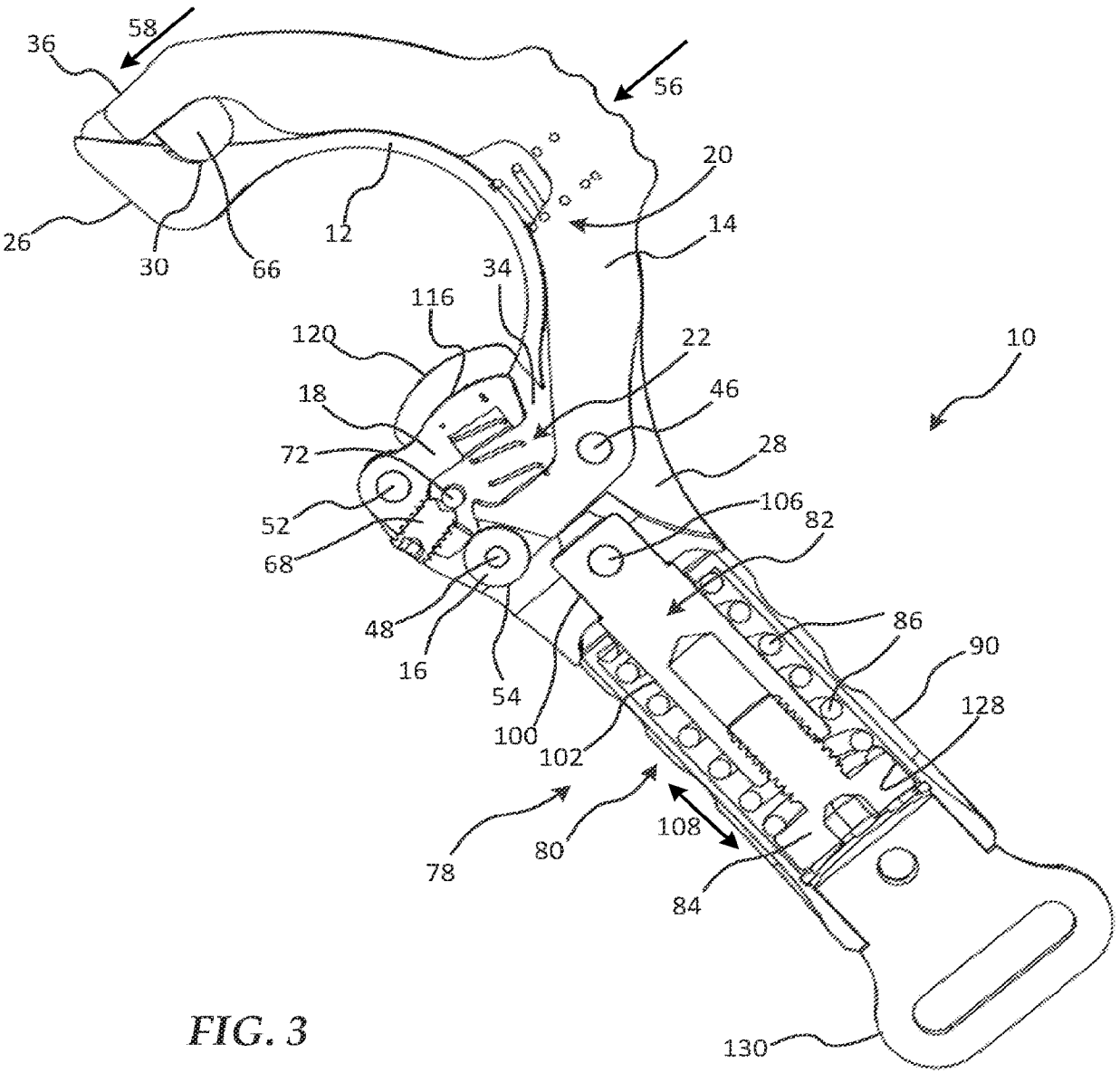
FIG. 3 is a cross-sectional view of a non-limiting exemplary embodiment of a bowstring release.
Figure 4:
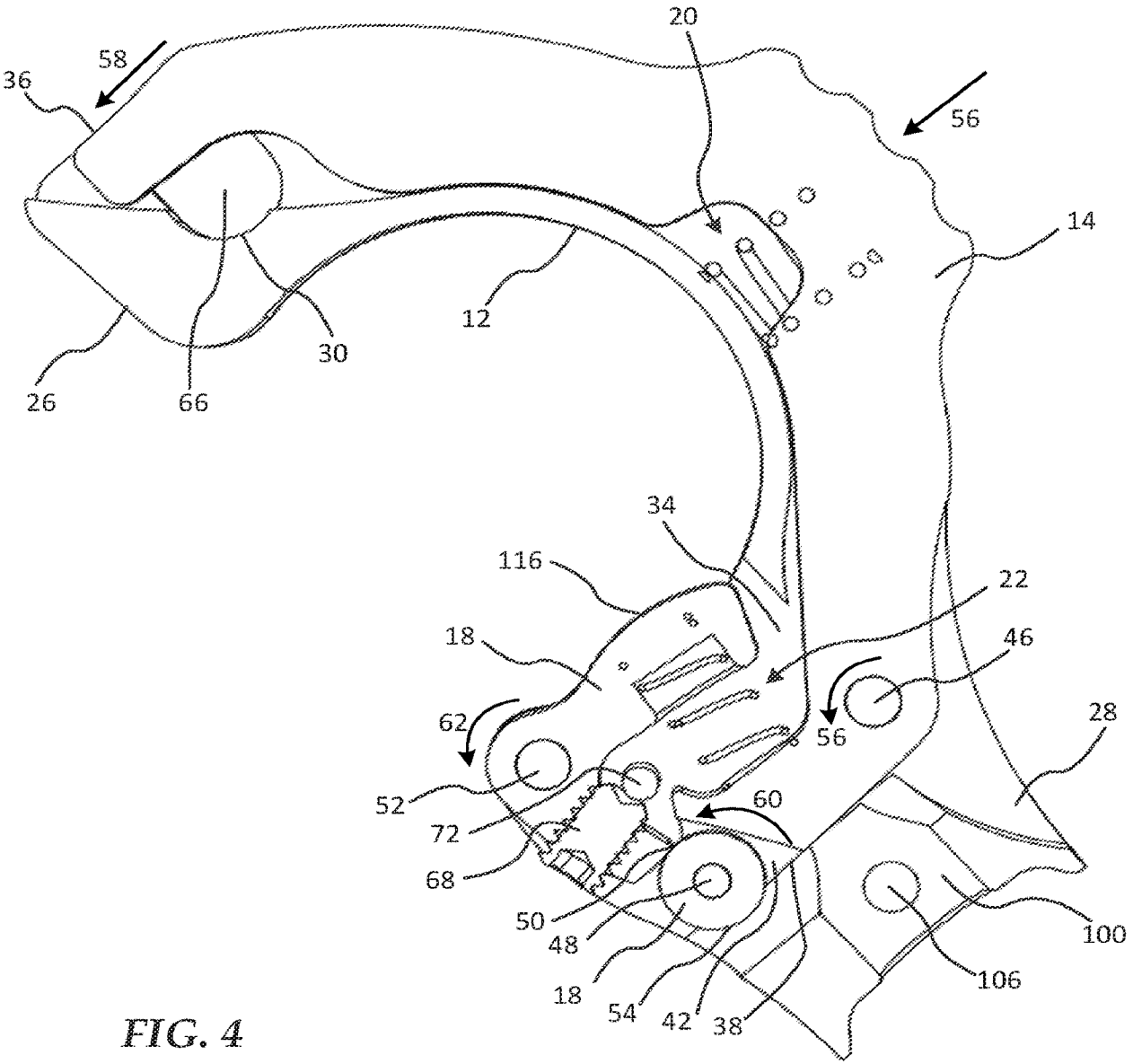
FIG. 4 is a close-up view of a portion of the cross-section illustrated in FIG. 3.
Figure 5:
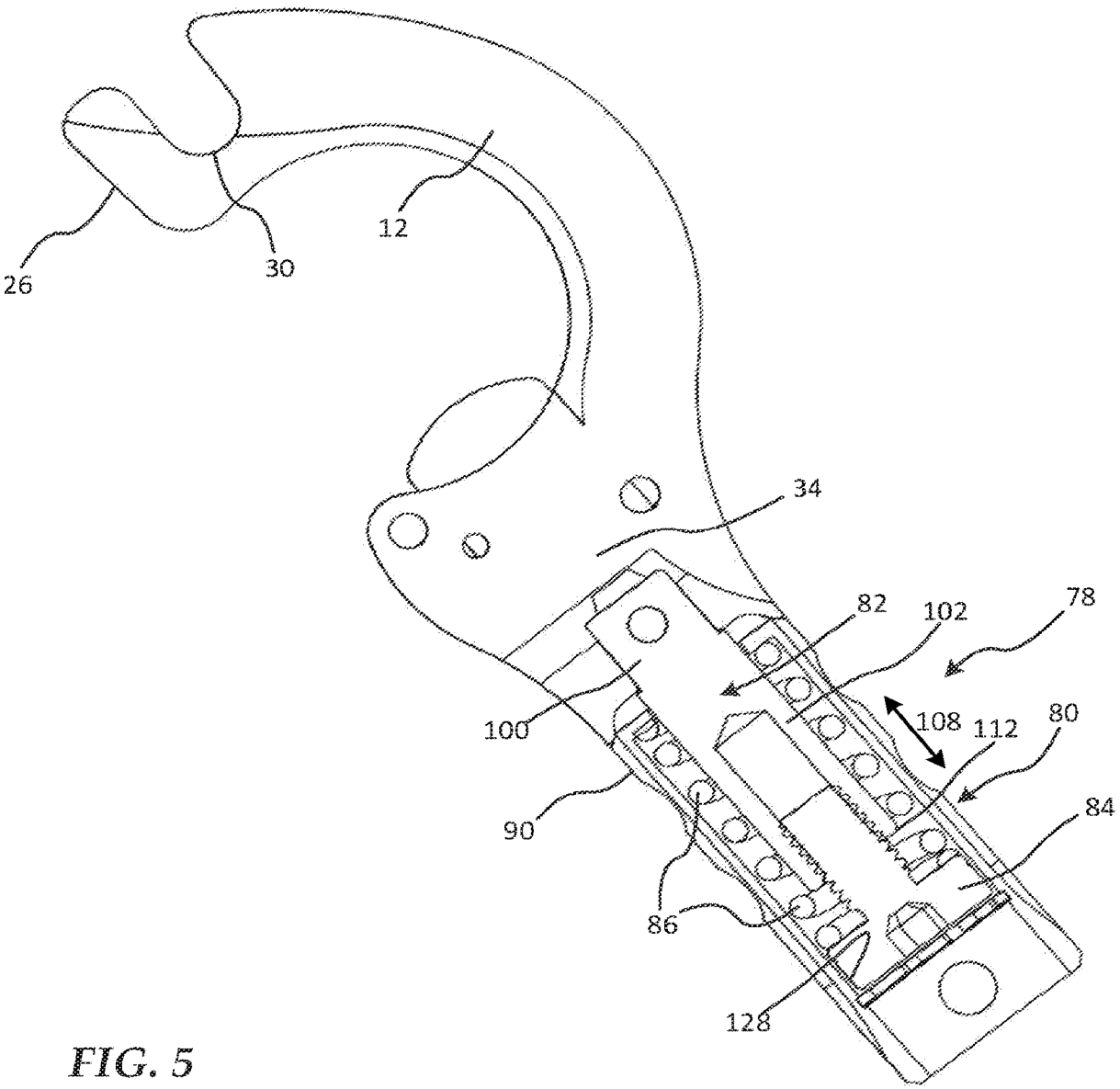
FIG. 5 is a close-up view of another portion of the cross-section illustrated in FIG. 3.
Figure 6A:
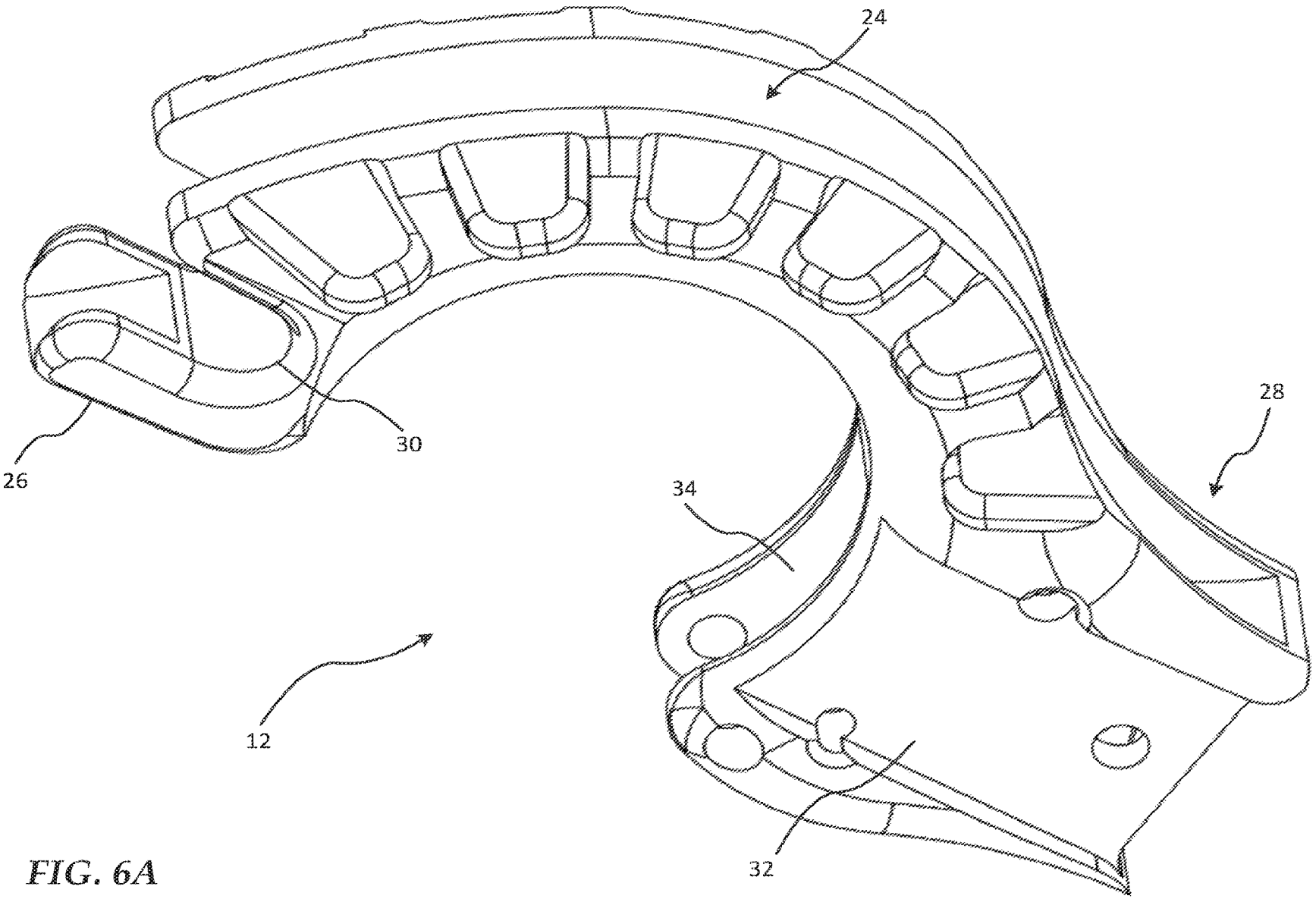
FIGS. 6A and 6B are perspective views of a non-limiting exemplary embodiment of a body for the bowstring release illustrated in FIGS. 1-3.
Figure 6B:
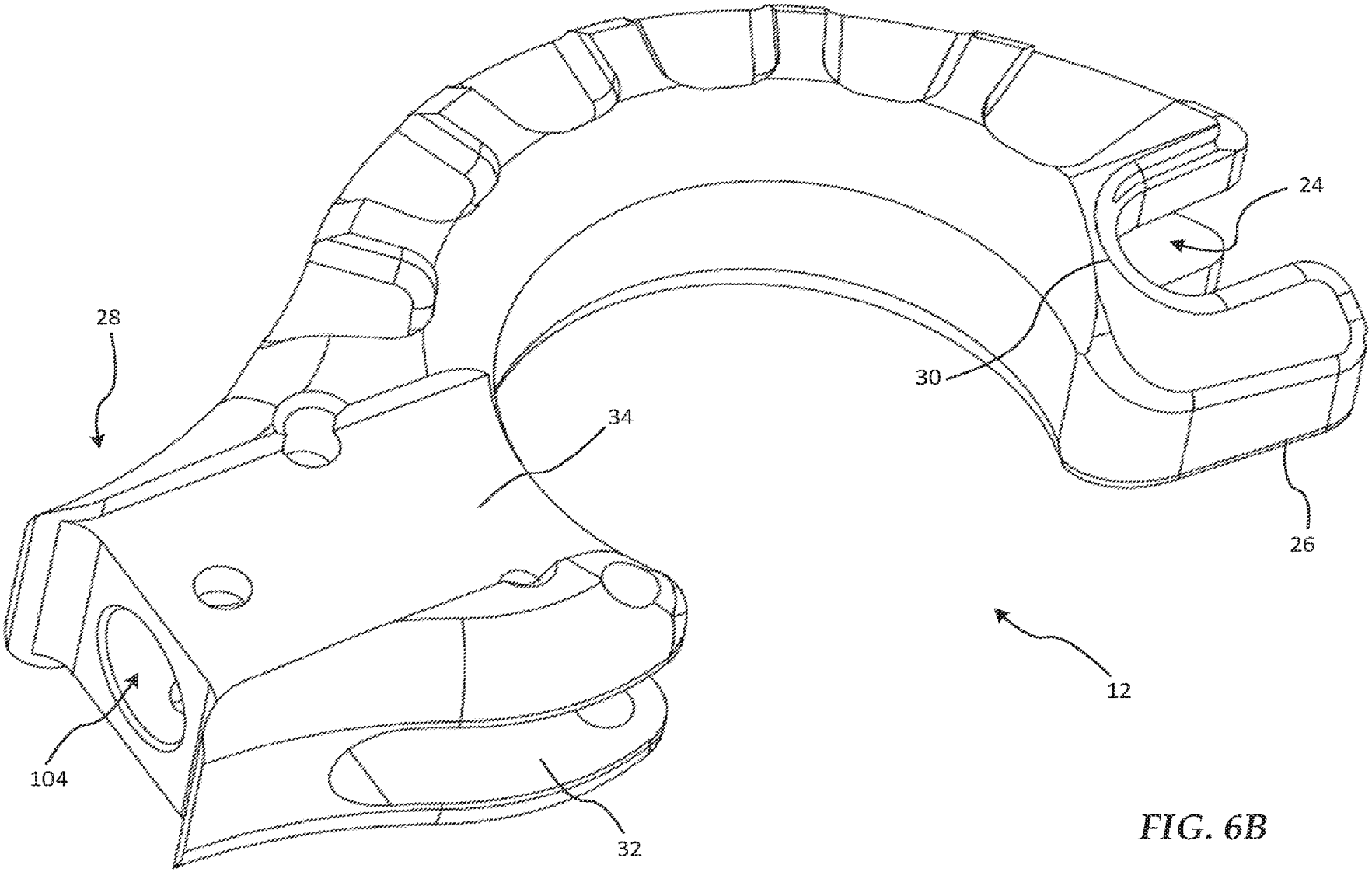
Figure 7A:
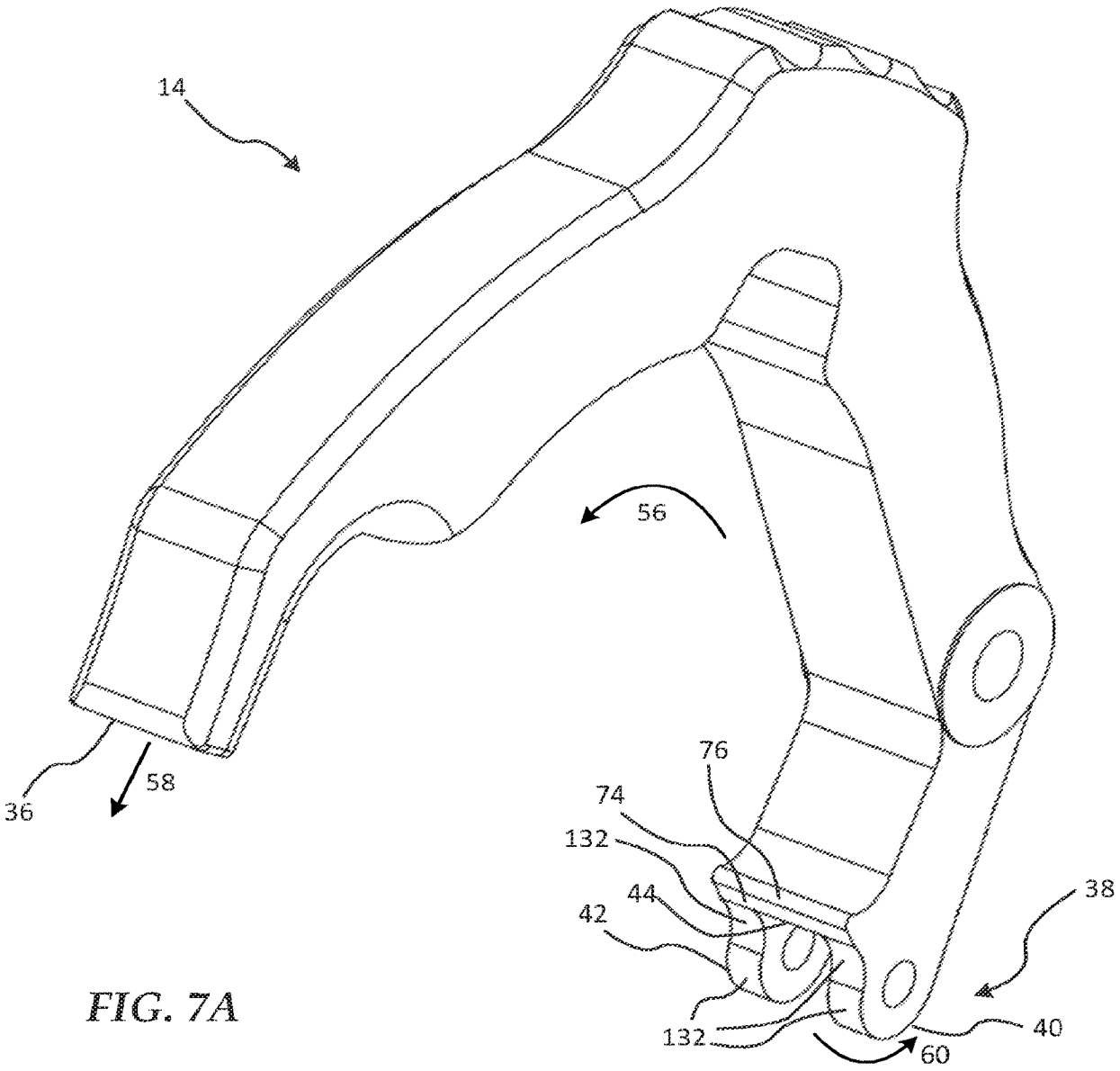
FIGS. 7A and 7B are perspective views of a non-limiting exemplary embodiment of a jaw for the bowstring release illustrated in FIGS. 1-3.
Figure 7B:
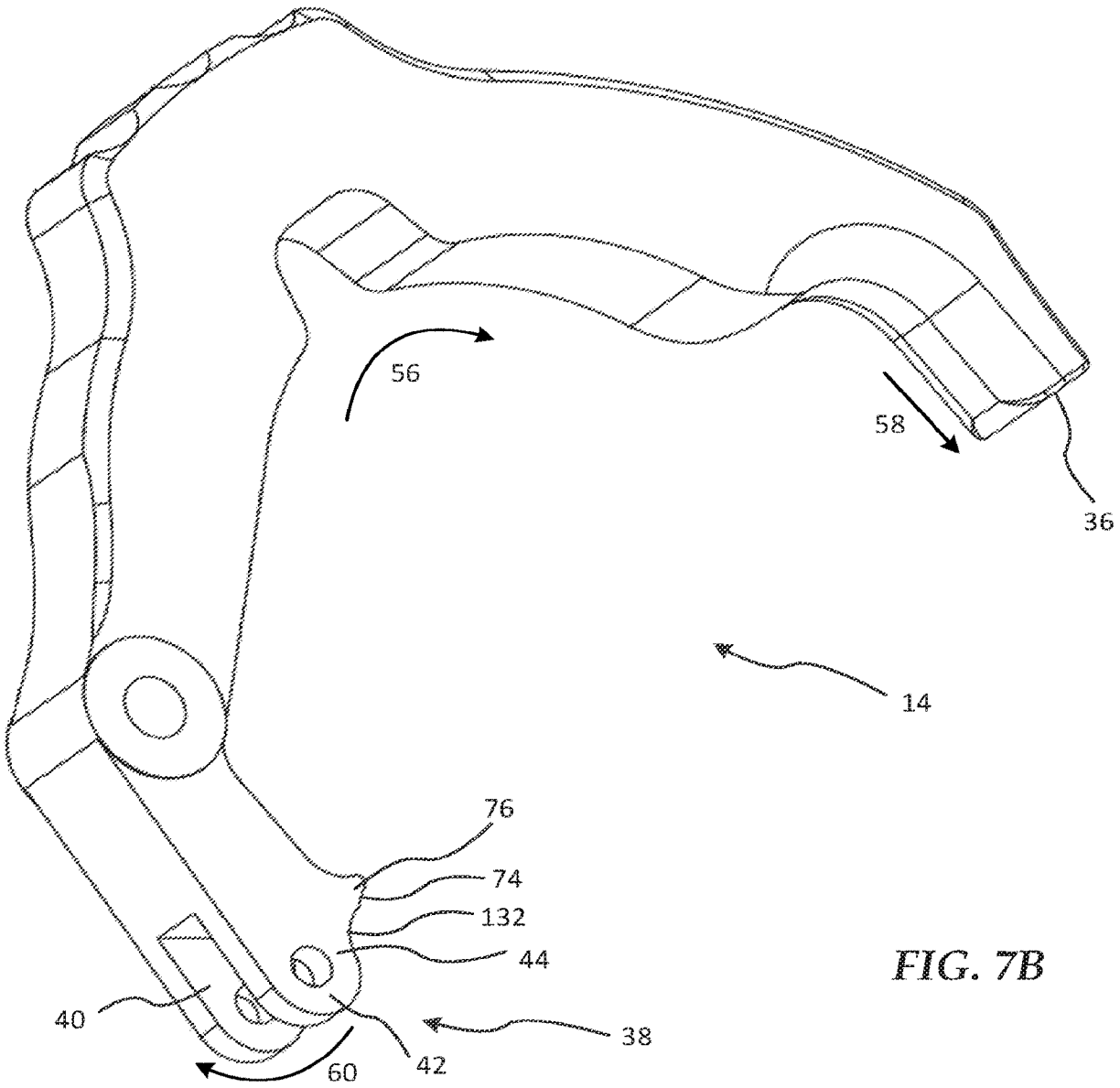
Figure 8:
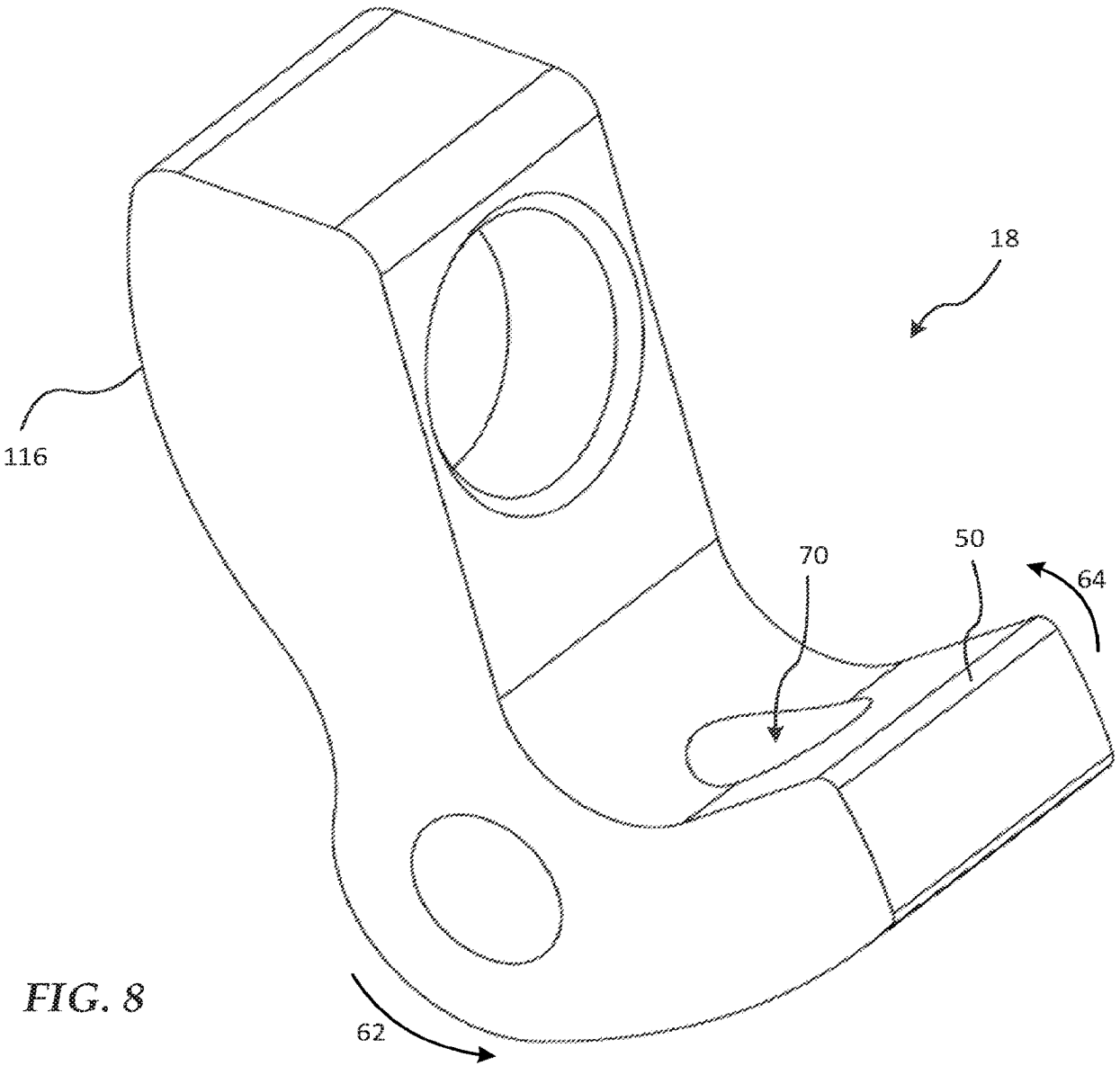
FIG. 8 is a perspective view of a non-limiting exemplary embodiment of a trigger for the bowstring release illustrated in FIGS. 1-3.
Figure 9A:
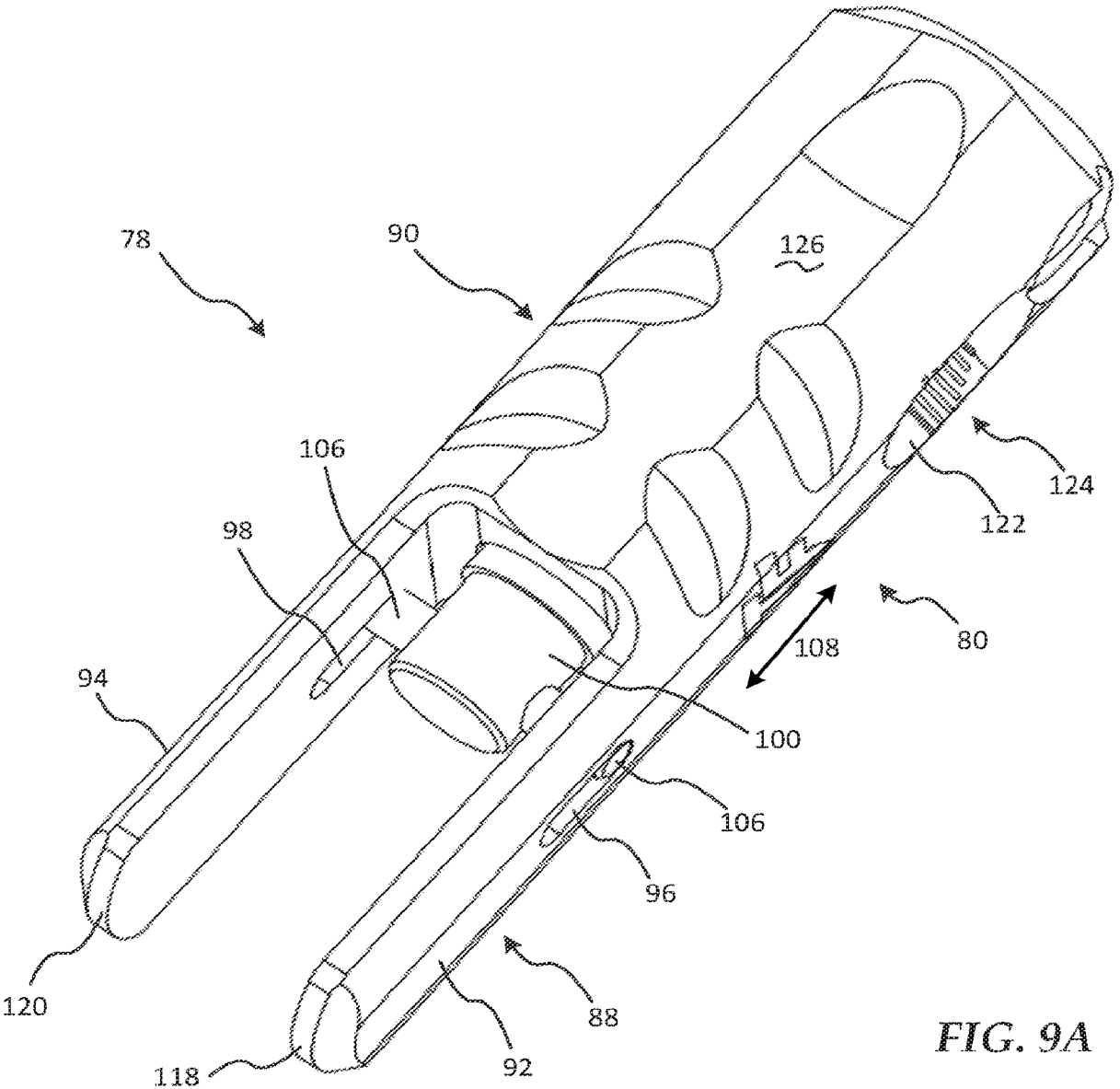
FIGS. 9A and 9B are perspective views of a non-limiting exemplary embodiment of a back tension adjustment apparatus for the bowstring release illustrated in FIGS. 1-3.
Figure 9B:
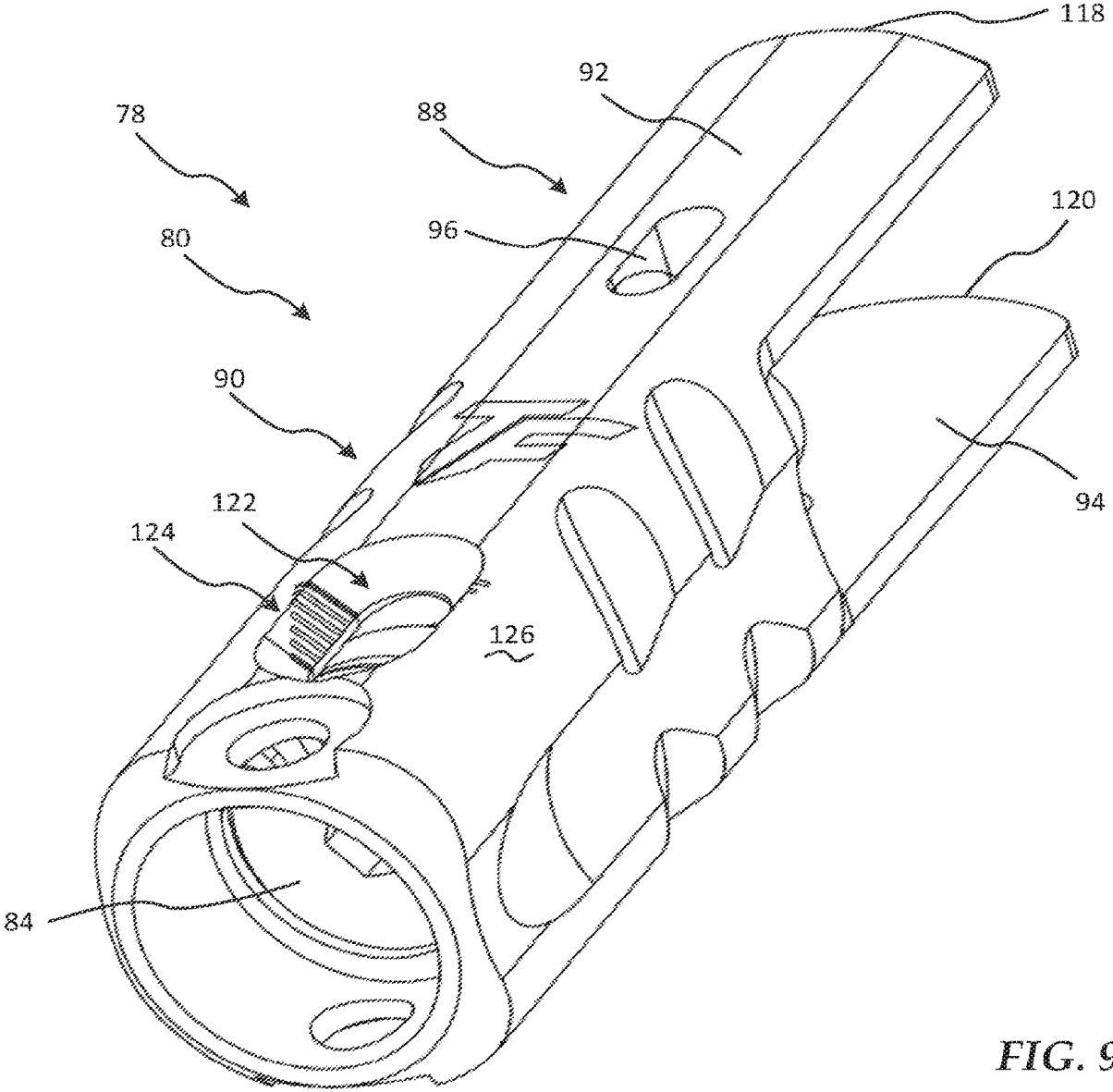
Figure 10A:
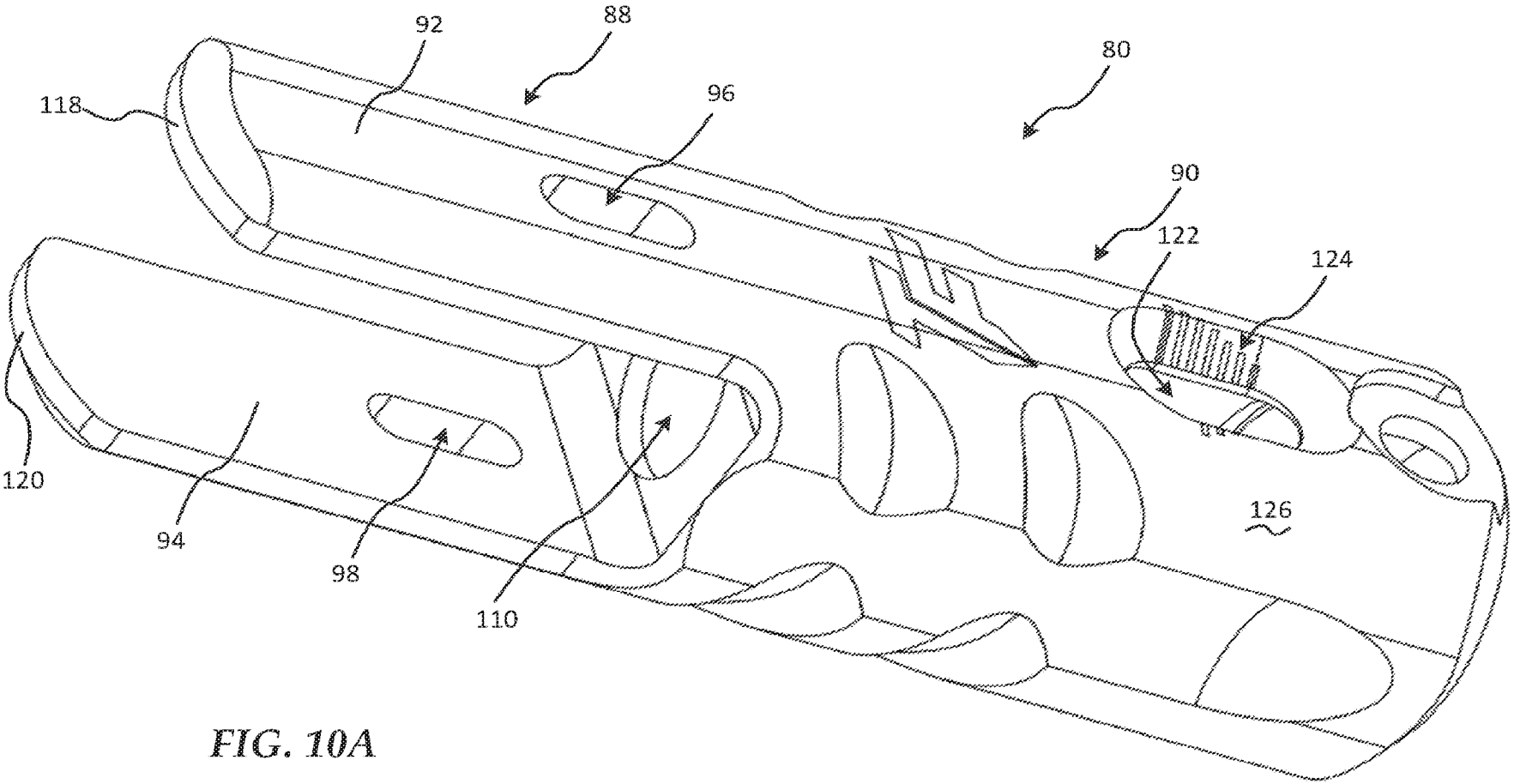
FIGS. 10A and 10B are perspective views of a non-limiting exemplary embodiment of a sheath for the back tension adjustment apparatus illustrated in FIGS. 9A and 9B.
Figure 10B:
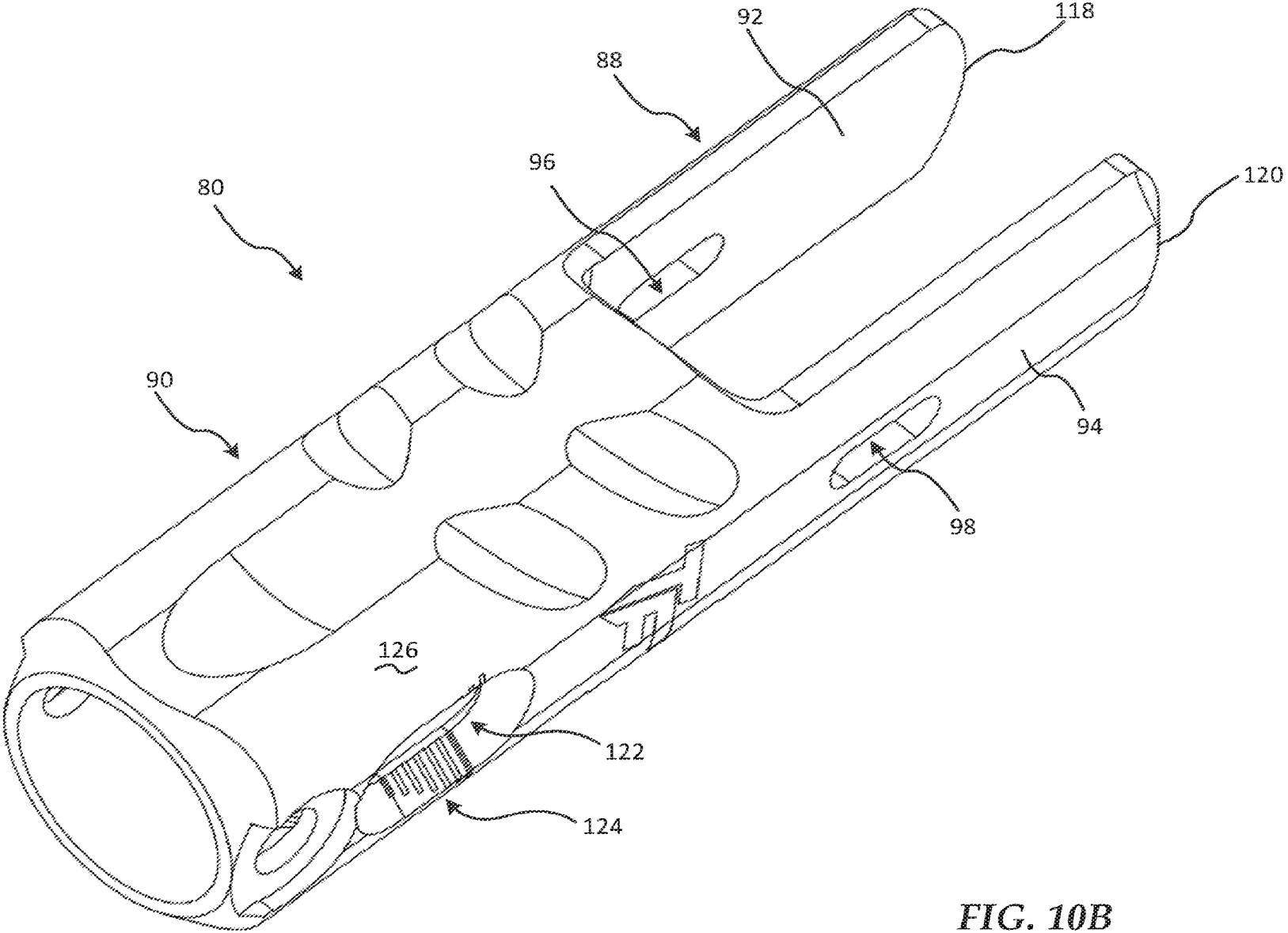
Figure 10C:
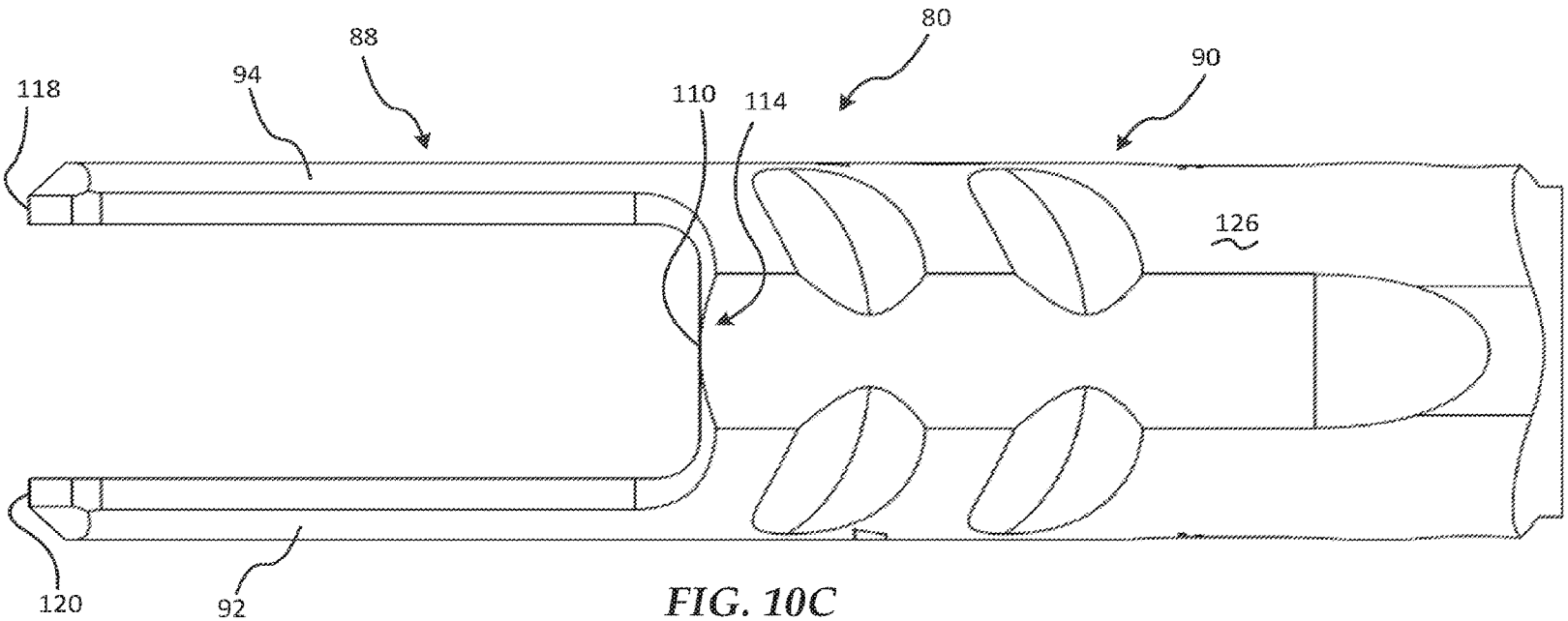
FIG. 10C is a cross-sectional view of the sheath illustrated in FIGS. 10A and 10B.
Figure 10D:
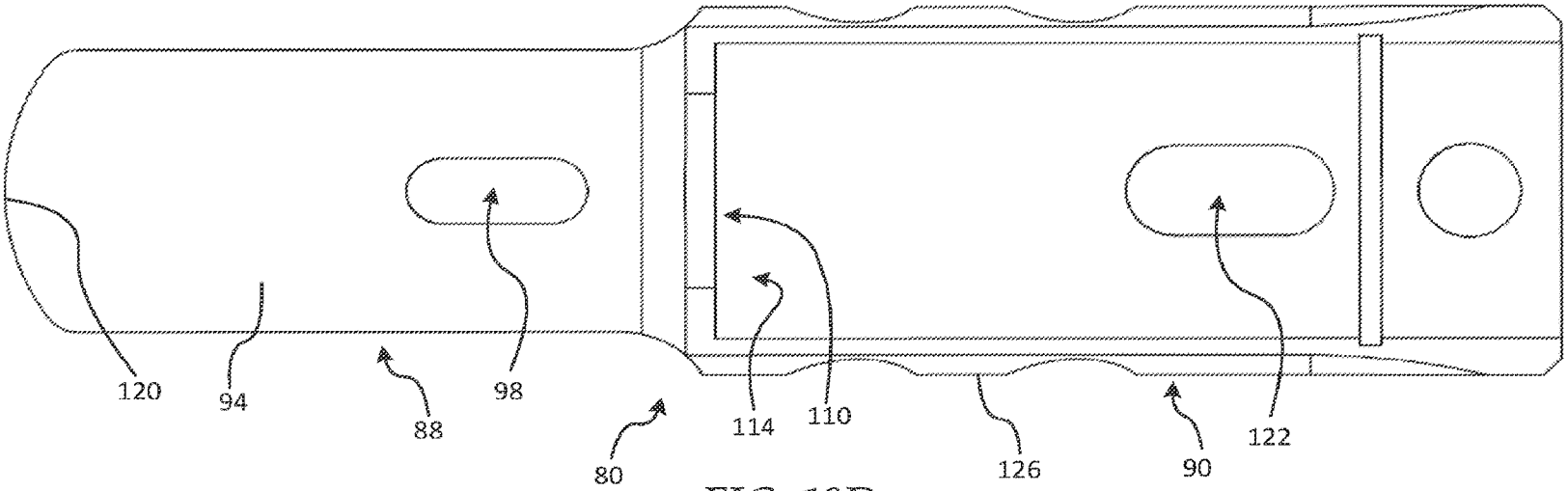
FIG. 10D is a cross-sectional view of the sheath orthogonal to the view illustrated in FIG. 10C.
Figure 11:
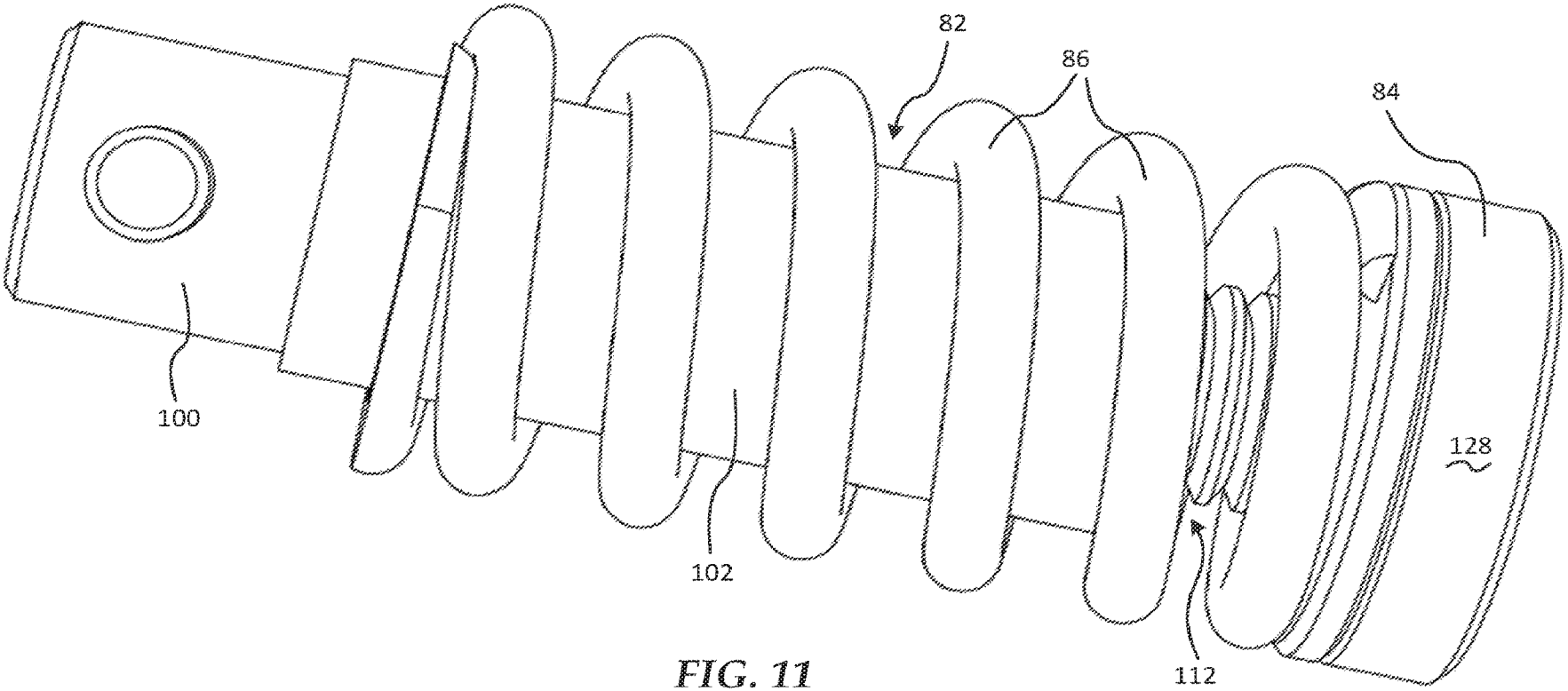
FIG. 11 is a side view of the internal components of the back tension adjustment apparatus illustrated in FIGS. 9A and 9B.
Figure 12:
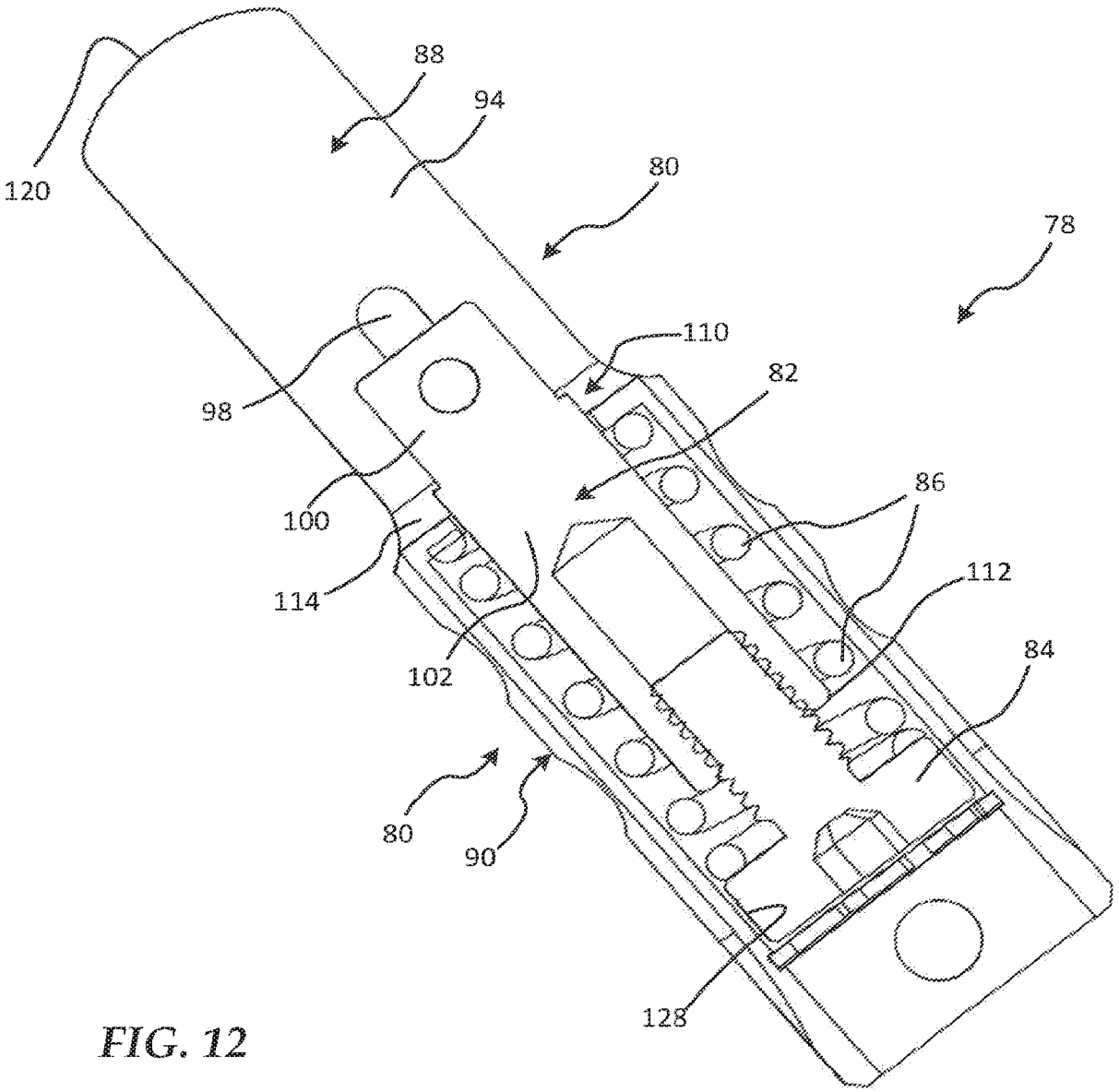
FIG. 12 is a cross-sectional view of the back tension adjustment apparatus illustrated in FIGS. 9A and 9B.
Figure 13:
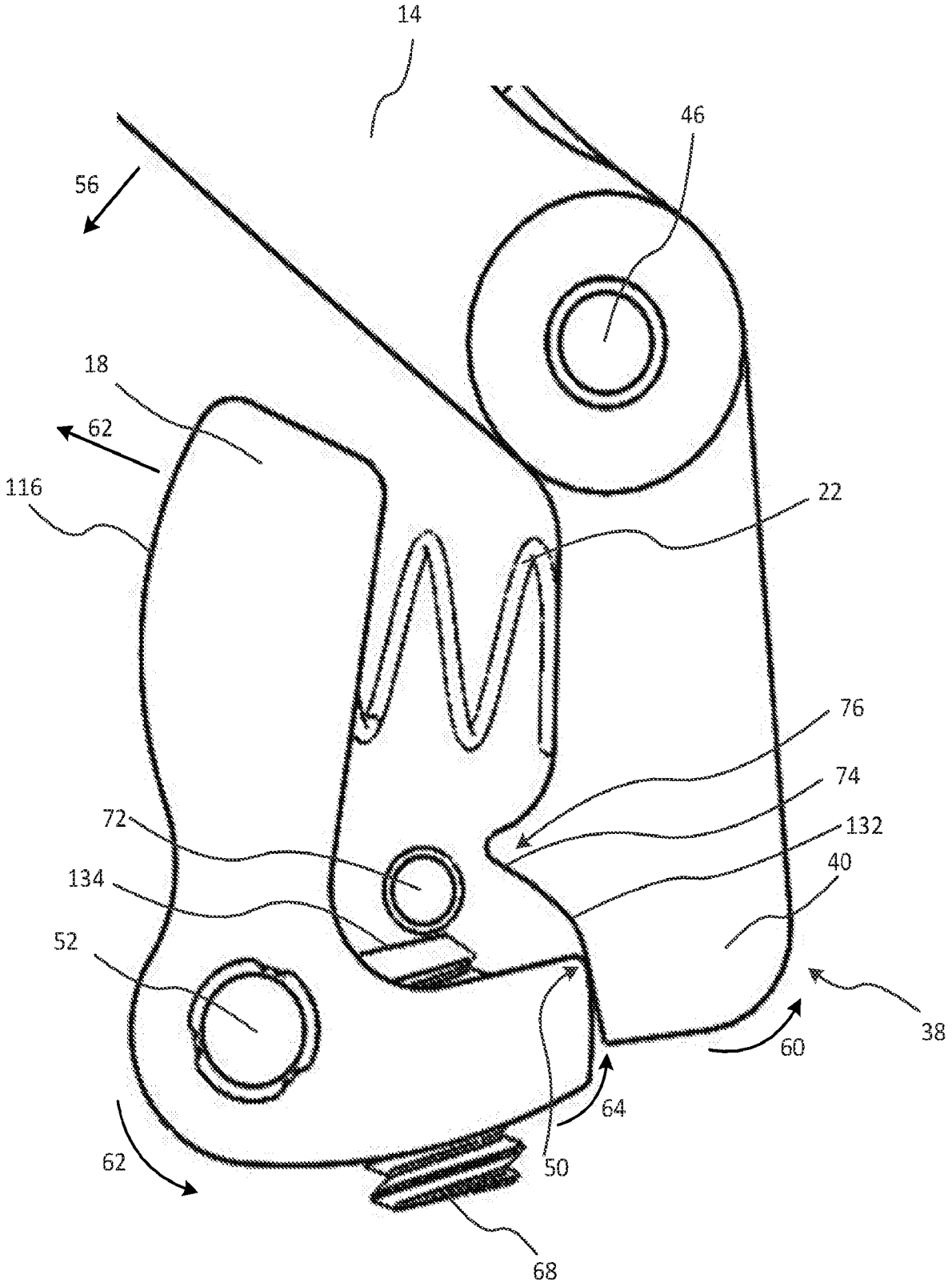
FIG. 13 is a close-up view of the relative positions of the jaw and the trigger in a non-limiting exemplary embodiment of a bowstring release while the release is cocked.

FIGS. 1-5 illustrate various views of a non-limiting exemplary embodiment of a bowstring release 10, wherein FIGS. 1A and 1B are perspective views of the bowstring release 10, FIG. 2 is a side view of the bowstring release 10, FIG. 3 is a cross-sectional view of the bowstring release 10, FIG. 4 is a close-up view of a portion of the cross-section illustrated in FIG. 3, and FIG. 5 is a close-up view of another portion of the cross-section illustrated in FIG. 3.

In some non-limiting exemplary embodiments, the release 10 includes a body 12, a jaw 14, a trigger 18, a first biasing element 20, and a second biasing element 22.

A non-limiting exemplary embodiment of the body 12 is defined at least in part by a channel 24 extending between first and second ends 26 and 28. In certain exemplary embodiments, the body 12 includes spaced apart opposing walls 32 and 34 at the second end 28. In some exemplary embodiments, the body 12 includes a notch 30 at the first end 26.

A non-limiting exemplary embodiment of the jaw 14 is defined at least in part by first and second ends 36 and 38. In certain exemplary embodiments, the jaw 14 includes spaced apart opposing walls 40 and 42 at the second end 38. In some exemplary embodiments, at least a portion of the jaw 14 is disposed within the channel 24 of the body 12, and the opposing walls 40 and 42 at the second end 38 of the jaw 14 are disposed between the opposing walls 32 and 34 of the body 12. In some exemplary embodiments, a dowel or a pin 46 pivotally or rotatably couples the body 12 and the jaw 14 to each other.

A non-limiting exemplary embodiment of the trigger 18 includes an edge 50. In some exemplary embodiments, the trigger 18 is disposed between the opposing walls 32 and 34 at the second end 28 of the body 12, and a dowel or pin 52 pivotally or rotatably couples the body 12 and the trigger 18 to each other.

In some exemplary embodiments, the trigger edge 50 and a surface 132 of the jaw 14 proximate the second end 38 are slidably engaged. In certain embodiments, the trigger edge 50 and the surface 132 slide relative to each other when the trigger 18 is operated towards or away from the jaw 14, i.e., when the trigger is pulled or when the release 10 is cocked. In some embodiments, the surface 132 of the jaw 14 slides relative to the trigger edge 50. In certain embodiments, the trigger edge 50 slides along the surface 132 of the jaw 14. In some embodiments, both the trigger edge 50 and the surface 132 slide. In certain exemplary embodiments, the trigger edge 50 and the surface 132 of the jaw 14 dis-engage when the trigger is pulled.

In some embodiments, the second biasing element 22 is disposed between the jaw 14 and the trigger 18. In certain embodiments, a biasing force from the second biasing element 22 applied to the jaw 14 and the trigger 18 is sufficient to retain or maintain the trigger edge 50 and the surface 132 of the jaw 14 engaged while the release 10 is cocked. In certain embodiments, a biasing force from the first biasing element 20 and/or the biasing force from the second biasing element 22 are/is not sufficient to dis-engage the trigger edge 50 and the surface 132 of the jaw 14 while the release 10 is cocked.

In some embodiments, the second biasing element 22 is a compression spring. In certain embodiments, the second biasing element 22 is an expansion spring. It should be clearly understood that there is no intent, implied or otherwise, to limit the second biasing element 22 to a spring. Alternate means of providing the described functionality of the second biasing element 22 are considered as being within the metes and bounds of this disclosure In certain exemplary embodiments, a latching notch is provided on the surface 132 of the jaw 14. In some exemplary embodiments, trigger edge 50 and the latching notch on the surface 132 remain engaged while the release 10 is cocked. In certain embodiments, the trigger edge 50 and the latching notch dis-engage when the trigger is pulled. In some embodiments, the biasing force from the second biasing element 22 applied to the jaw 14 and the trigger 18 is sufficient to retain or maintain the trigger edge 50 and the latching notch on the surface 132 of the jaw 14 engaged while the release 10 is cocked. In certain embodiments, a biasing force from the first biasing element 20 and/or the biasing force from the second biasing element 22 are/is not sufficient to dis-engage the trigger edge 50 and the latching notch on the surface 132 of the jaw 14 while the release 10 is cocked.

In certain exemplary embodiment, the release 10 includes a roller 16 disposed between opposing walls 40 and 42 of the jaw 14. In some exemplary embodiments, a dowel or a pin 48 couples the jaw 14 and the roller 16 to each other. In certain exemplary embodiments, the roller 16 rotates unhindered between the opposing walls 40 and 42. In some exemplary embodiments, the roller 16 is inhibited from rotating between the opposing walls 40 and 42.

In certain exemplary embodiments, the trigger edge 50 and a surface 54 of the roller 16 are slidably engaged. In some exemplary embodiments, the trigger edge 50 and the surface 54 slide relative to each other when the trigger 18 is operated towards or away from the jaw 14, i.e., when the trigger 18 is pulled or when the release 10 is cocked. In certain exemplary embodiments, the roller 16 rotates when the trigger edge 50 slides along the surface 54. In some exemplary embodiments, the roller 16 does not rotate when the trigger edge 50 slides along the surface 54. In certain exemplary embodiments, the surface 54 of the roller 16 slides along the trigger edge 50.

In some exemplary embodiments, the second biasing element 22 is disposed between the jaw 14 and the trigger 18. In certain exemplary embodiments, the biasing force from the second biasing element 22 applied to the jaw 14 and the trigger 18 is sufficient to retain or maintain the trigger edge 50 and the surface 54 of the roller 16 engaged while the release 10 is cocked. In some exemplary embodiments, a force from the first biasing element 20 and/or the force from the second biasing element 22 are/is not sufficient to dis-engage the trigger edge 50 and the surface 54 of the roller 16 while the release 10 is cocked. In certain exemplary embodiments, the trigger edge 50 and the roller 16 dis-engage when the trigger is pulled.

In certain non-limiting exemplary embodiments, the first biasing element 20 is disposed between the body 12 and the jaw 14. In some exemplary embodiments, a biasing force from the first biasing element 20 separates at least portions of the body 12 and the jaw 14 sufficiently to maintain the release 10 in an un-cocked state such as that after the trigger 18 has been pulled.

In some exemplary embodiments, the first end 36 of the jaw 14 is configured for holding or retaining a bowstring during draw and when fully drawn, i.e., when the release 10 is cocked. In certain exemplary embodiments, the first end 36 of the jaw 14 is configured as a hook or claw for holding or retaining the bowstring. In some embodiments, the first end 36 of the jaw 14 is configured for holding or retaining the bowstring when fully drawn. In certain embodiments, the first end 36 of the jaw 14 is configured for holding or retaining the bowstring while the release 10 is cocked.

In some non-limiting exemplary embodiments, the body 12 includes a notch 30 at the first end 26. In certain embodiments, the first end 36 of the jaw 14 is configured for keeping the notch 30 at first end 26 of body 12 unblocked while the release 10 is not cocked. In other words, while the release 10 is not cocked, the biasing force from the first biasing element 20 applied to the body 12 and the jaw 14 is sufficient to inhibit the first end 36 of the jaw 14 from blocking the notch 30 at first end 26 of body 12. In certain exemplary embodiments, the first biasing element 20 is a compression spring. In some exemplary embodiments, the first biasing element 20 is an expansion spring. It should be clearly understood that there is no intent, implied or otherwise, to limit the first biasing element 20 to a spring. Alternate means of providing the described functionality of the second biasing element 22 are considered as being within the metes and bounds of this disclosure.

In certain non-limiting exemplary embodiments, moving at least a portion of the jaw 14 into the channel 24 of the body 12 concurrently cocks the release 10 and moves the first end 36 of the jaw 14 in the direction 58. For cocking the release 10, the archer moves the jaw 14 in the direction 56 whereby the first end 36 of the jaw 14 moves in the direction 58. Concurrently, a biasing energy or force starts getting stored in the first biasing element 20. Also concurrently, the second end 38 of the jaw 14 moves in the direction 60, and the biasing force from the second biasing element 22 moves the trigger 18 away from the jaw 14 in the direction 62 whereby the trigger edge 50 moves in the direction 64 until the trigger edge 50 and the jaw 14 engage. The archer may place or position the bowstring against the first end 38 of the jaw 14 either before or after cocking the release 10. The archer releases the bowstring, i.e., "pulls" the trigger 18, by moving the trigger 18 towards the jaw 14 in the direction opposite the direction 62. For instance, the archer applies a pressure on the trigger 18 in the direction opposite the direction 62 to overcome the biasing force of the second biasing element 22. In some exemplary embodiments, the trigger edge 50 slides along the surface 132 of the jaw 14 in the direction opposite the direction 64 until the biasing force of the first biasing element 20 moves the jaw 14 in the direction opposite the direction 56 whereby the first end 36 of the jaw 14 moves in the direction opposite the direction 58 whereby the drawn bowstring is released to propel a projectile downrange. In certain exemplary embodiments, the trigger edge 50 and the surface 132 of the jaw 14 slide relative to each other.

In embodiments wherein the latching notch 44 is provided on the surface 132 of the jaw 14, the trigger edge 50 and the latching notch 44 dis-engage when the trigger 18 is pulled. Thereafter, the trigger edge 50 slides along the surface 132 of the jaw 14 in the direction opposite the direction 64 until the biasing force of the first biasing element 20 moves the jaw 14 in the direction opposite the direction 56 whereby the first end 36 of the jaw 14 moves in the direction opposite the direction 58 whereby the drawn bowstring is released to propel a projectile downrange.

In embodiments wherein the roller 16 is provided, pulling the trigger 18 causes the trigger edge 50 to slide along the surface 54 of the roller 16 in the direction opposite the direction 64 until the biasing force of the first biasing element 20 moves the jaw 14 in the direction opposite the direction 56 whereby the first end 36 of the jaw 14 moves in the direction opposite the direction 58 and the drawn bowstring is released to propel a projectile downrange. In certain exemplary embodiments, the trigger edge 50 and the surface 54 of the roller 16 slide relative to each other.

In certain non-limiting exemplary embodiments, moving at least a portion of the jaw 14 into the channel 24 of the body 12 concurrently cocks the release 10 and moves the first end 36 of the jaw 14 in the direction 58 to block the notch 30 at the first end 26 of the body 12. When cocking the release 10, the archer places or positions the bowstring within the notch 30 and thereafter moves the jaw 14 in the direction 56 whereby the first end 36 of the jaw 14 moves in the direction 58 and starts blocking the notch 30 at the first end 26 of the body 12. Concurrently, a biasing energy or force starts getting stored in the first biasing element 20. Also concurrently, the second end 38 of the jaw 14 moves in the direction 60, and the biasing force from the second biasing element 22 moves the trigger 18 away from the jaw 14 in the direction 62 whereby the trigger edge 50 moves in the direction 64 until the trigger edge 50 and the jaw 14 engage. It will be appreciated that the components or elements of the release 10 are configured and/or dimensioned and/or selected such that when the trigger edge 50 and the jaw 14 engage, the notch 30 at the first end 26 of the body 12 is blocked by the first end 36 of the jaw 14 entrapping or capturing the bowstring.

It will be appreciated that the biasing forces of the first and second biasing elements 20 and 22 are sufficiently balanced to ensure that the trigger edge 50 and the jaw 14 do not disengage while the release 10 is cocked, until the archers pulls the trigger.

It will be appreciated that cocking the release 10 will most likely commence just prior to drawing the bowstring (not shown) placed either against the first end 36 of the jaw 14 or in a blocked space 66 at respective first ends 26 and 36 of the body 12 and the jaw 14. Generally, prior to cocking the release 10, the archer will first place the bowstring either against the first end 36 of the jaw 14 or within the notch 30 at the first end 26 of the body 12. Then, the archer will start cocking the release 10 by moving the jaw 14 in the direction 56 causing movement of the first end 36 of the jaw 14 in the direction 58 until the trigger edge 50 and the jaw 14 engage. In embodiment having the notch 30, the notch 30 is also blocked by the first end 36 of the jaw 14 with the bowstring entrapped or captured in the space 66. After the release 10 is cocked, the archer draws the bowstring by pulling the release 10 in the proximal direction, i.e., towards him/her.

Figure 14:
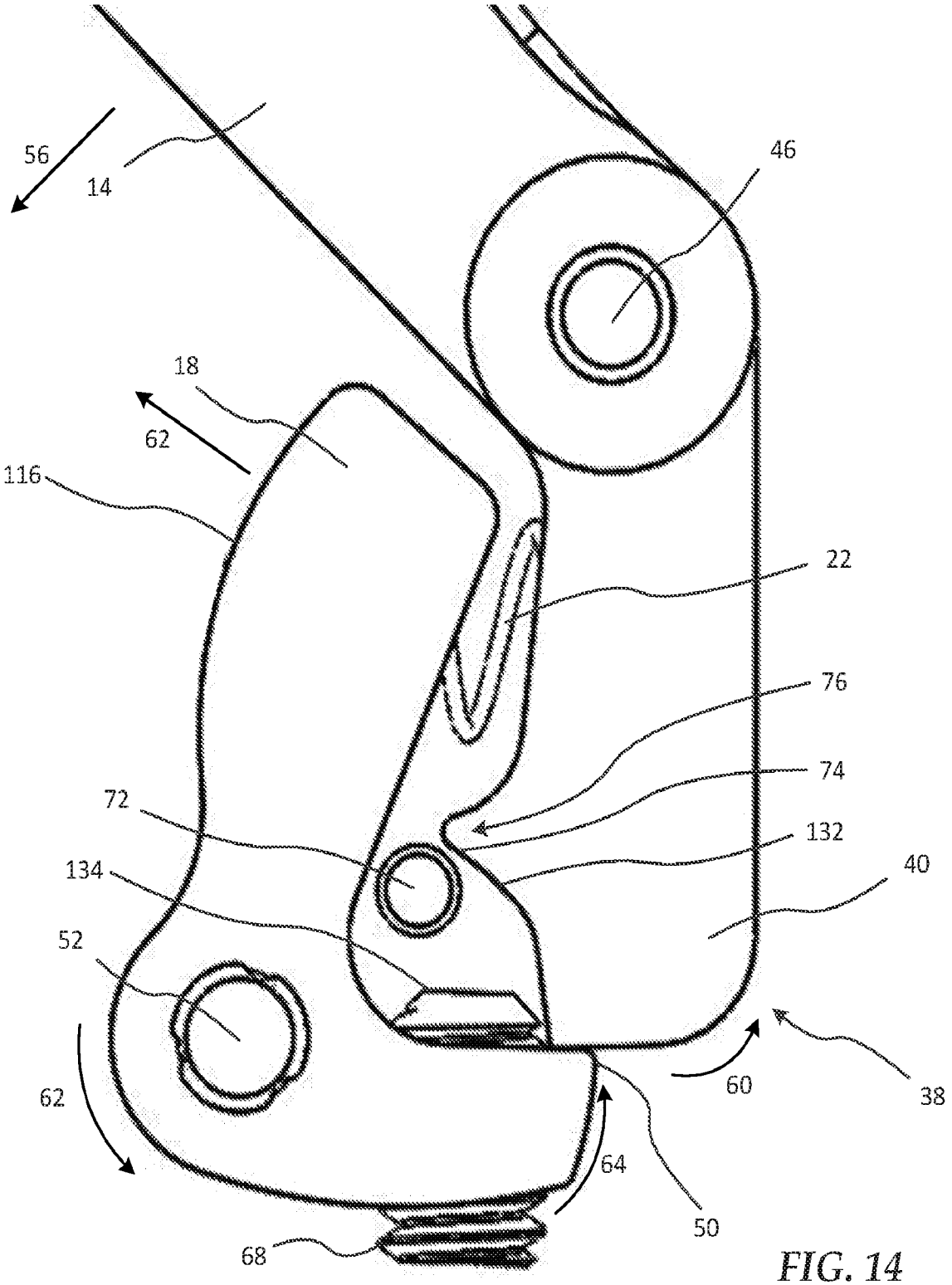
FIG. 14 illustrates the relative positions of the jaw and the trigger in the embodiment of FIG. 13 after the trigger is pulled, i.e., after the bowstring is released.
Figure 15:
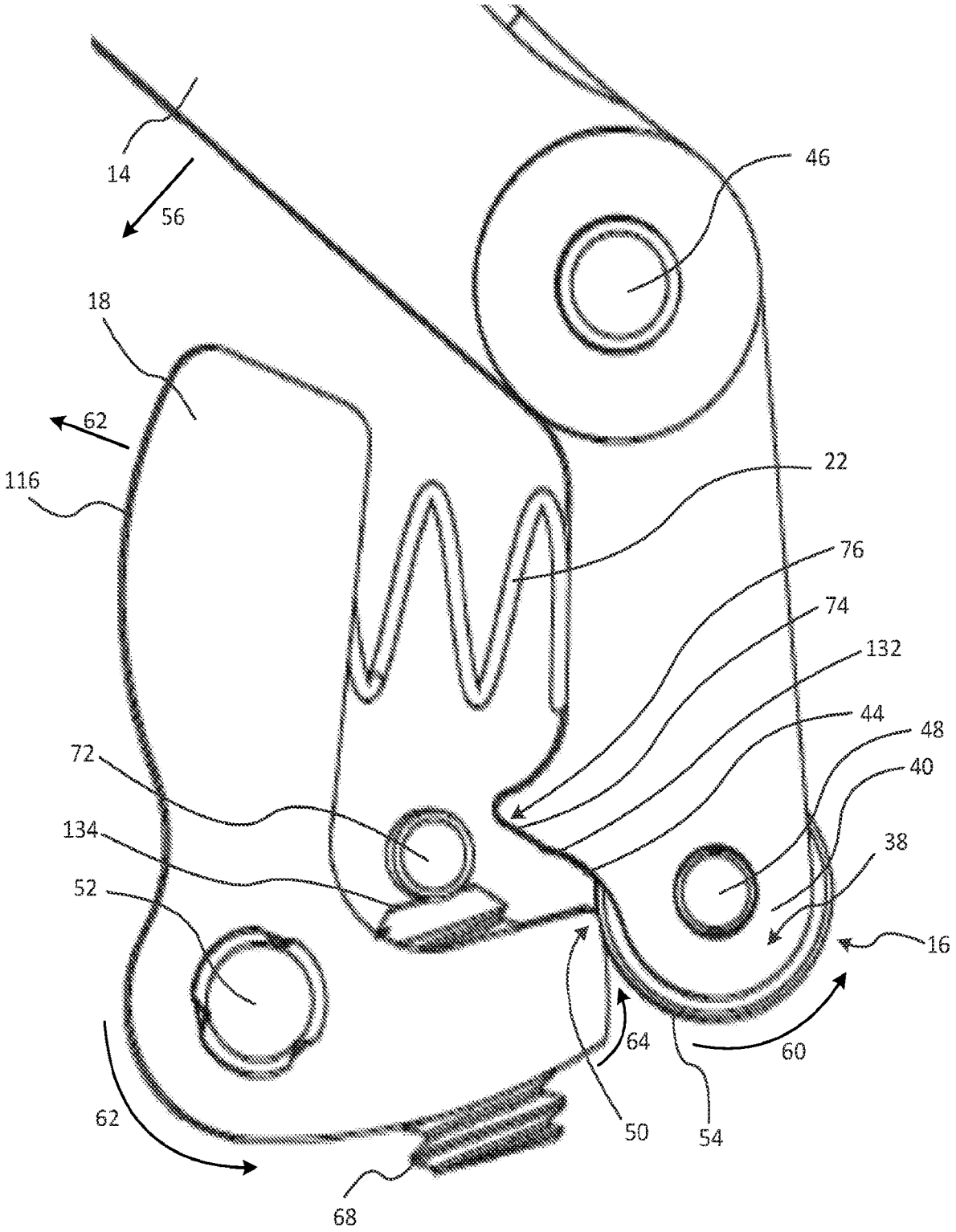
FIG. 15 is a close-up view of the relative positions of the jaw and the trigger in another non-limiting exemplary embodiment of a bowstring release while the release is cocked is cocked.
Figure 16:
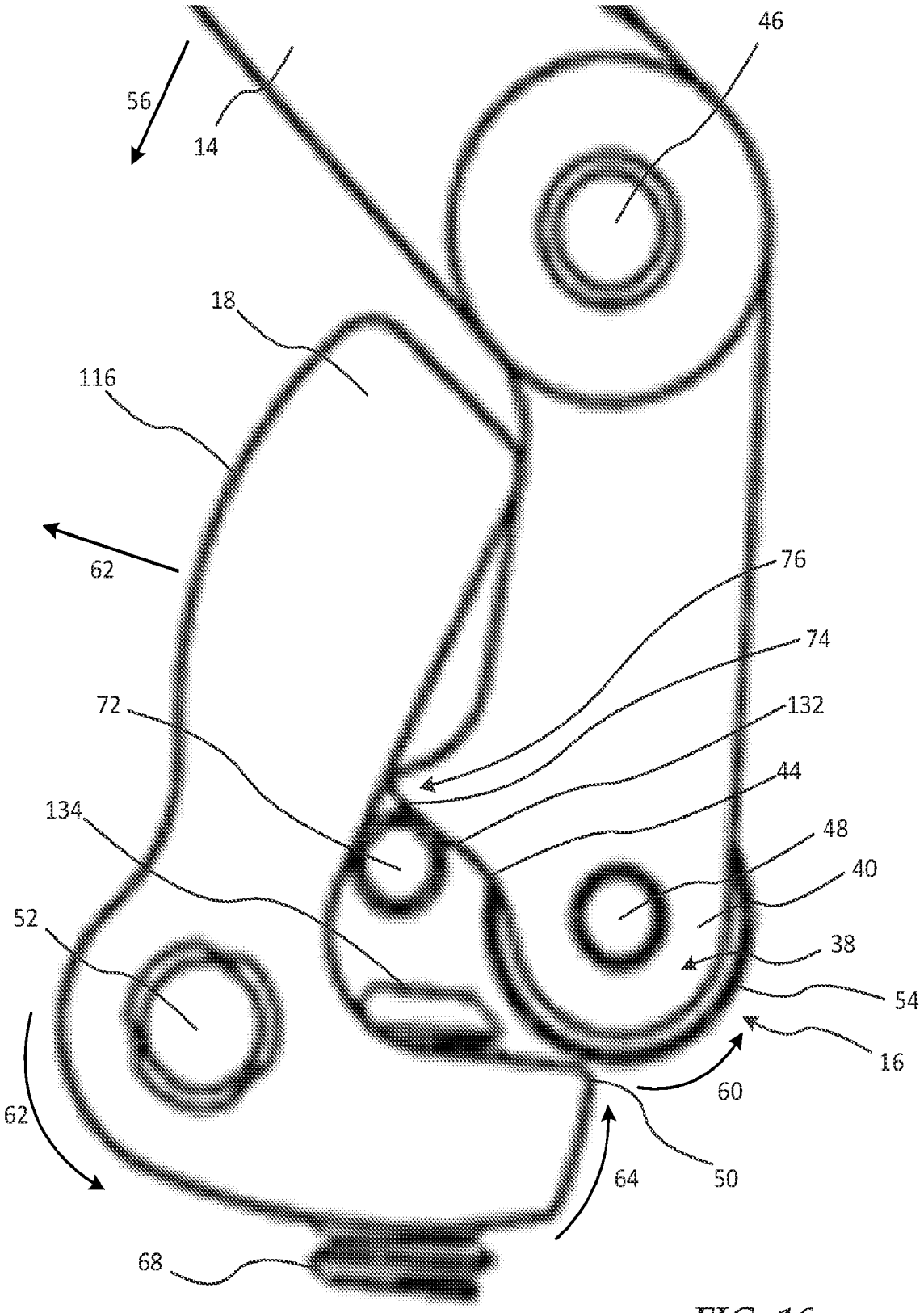
FIG. 16 illustrates the relative positions of the jaw and the trigger in the embodiment of FIG. 15 after the trigger is pulled, i.e., after the bowstring is released.

In a non-limiting exemplary embodiment, after the release 10 is cocked with the bowstring entrapped or captured in the space 66 and the bowstring is fully drawn, the archer "pulls" the trigger 18 by moving the trigger 18 towards the jaw 14 in the direction opposite the direction 62. For instance, the archer applies a pressure on the trigger 18 in the direction opposite the direction 62 to overcome the biasing force of the second biasing element 22. In some exemplary embodiments, the trigger edge 50 slides along the surface 132 of the jaw 14. In embodiments having the latching notch 44, the trigger edge 50 and the latching notch 44 disengage and the trigger edge 50 slides along the surface 132 of the jaw 14. In embodiments having the roller 16, the trigger edge 50 slides along the surface 54 of the roller 16. The trigger edge 50 will slide along the surface 132 of the jaw 14 or the surface 54 of the roller 16 in the direction opposite the direction 64 until the biasing force of the first biasing element 20 moves the jaw 14 in the direction opposite the direction 56. In embodiments without the notch 30 at the first end 26 of the body 12, the drawn bowstring is released to propel the projectile downrange. In embodiments with the notch 30 at the first end 26 of the body 12, the first end 36 of the jaw 14 unblocks the notch 30 at the first end 26 of the body 12, and the drawn bowstring is released to propel a projectile downrange. In embodiments without the roller 16, the trigger edge 50 and the surface 132 of the jaw 14 slide relative to each other. In embodiments with the roller 16, the trigger edge 50 and the surface 54 of the roller 16 slide relative to each other. In some exemplary embodiments, the roller 16 rotates. For embodiments having the roller 16, FIG. 14 illustrates a non-limiting exemplary embodiment of the relative positioning of at least the jaw 14 and the trigger 18 after the cocked release 10 has been fired, i.e., after the trigger 18 has been "pulled".

In a non-limiting exemplary embodiment of the release 10, the first and second biasing elements 20 and 22 are selected such that their biasing forces are sufficiently balanced to ensure that the release 10 does not automatically cock. In other words, the archer must manually and deliberately cock the release 10.

In a non-limiting exemplary embodiment, the release 10 includes a trigger travel adjustment mechanism having an adjustment means 68 extending through a hole 70 in the trigger 18 and a stop 72 coupled to the opposing walls 32 and 34 at the second end 28 of the body 12. In some exemplary embodiments, the biasing force from the second biasing element 22 ensures that an end 134 of the adjustment means 68 and the stop 72 are in contact when the release 10 is cocked or when the release 10 is approaching the cocked state.

In some exemplary embodiments, the trigger travel adjustment mechanism is used for adjusting or changing the sensitivity of the trigger such as for instance changing the amount of pressure or force required to release the bowstring. In certain exemplary embodiments, the trigger travel adjustment mechanism is used for adjusting or changing the distance the trigger 18 must travel for releasing the bowstring after the release 10 is cocked. In some exemplary embodiments, the adjustment means 68 is set for engaging the trigger edge 50 and the jaw 14 when the release 10 is cocked. In certain exemplary embodiments, the adjustment means 68 is set for positioning the trigger edge 50 relative to the law 14 when the release 10 is cocked. In some exemplary embodiments, the adjustment means 68 is used for positioning the trigger edge 50 relative to the latching notch 44 when the release 10 is cocked. In a non-limiting exemplary embodiment, the adjustment means 68 is a screw, such as for example a set screw, which can be threaded towards or away from the stop 72 for adjusting the sensitivity and/or the travel distance of the trigger 18 when firing the cocked release 10. In certain exemplary embodiments, the adjustment means 68 is used for positioning the trigger edge 50 on the surface 132 of the jaw 14 or on the surface 54 of the roller 16 or on a surface 74 of a latching ledge 76 of the jaw 14 when the release 10 is cocked. Of course, the adjustment means 68 is used for engaging the trigger edge 50 and the jaw 14 when the release 10 is cocked. In view thereof, it will be readily apparent to one skilled in the art that the adjustment means 68 can be manipulated to adjust the sensitivity and/or the travel distance of the trigger 18 when firing the cocked release 10.

In a non-limiting exemplary embodiment, the biasing force of the first biasing element 20 is at least slightly greater than the biasing force of the second biasing element 22. In some exemplary embodiments, the biasing force of the first biasing element 20 assists in keeping the release 10 uncocked after the trigger 18 has been pulled. In certain exemplary embodiments, the biasing force of the second biasing element 22 is not sufficient to overcome the biasing force of the first biasing element 20 after the trigger 18 has been pulled, and therefore is not sufficient to cock the release 10. In other words, the biasing force of the second biasing element 22 is not sufficient to separate the jaw 14 and the trigger 18 after the trigger 18 has been pulled and, as such, prevents the latching notch 44 and the trigger edge 50 from engaging.

Although not shown, some non-limiting exemplary embodiments of release 10 include a release mount coupled with or attached to the second end 28 of the body 12. Also, while not shown, certain non-limiting exemplary embodiments of release 10 include a handle coupled with or attached to the second end 28 of the body 12. In some non-limiting exemplary embodiments, the release 10 includes a release mount coupled with or attached to the handle. The release mount enables easy attachment of the bowstring release 10 to a wrist band/strap, glove, or other arm mounting means for anchoring the release 10 to an archer's hand, wrist, or arm using, for example, flexible straps. The release 10 may therefore be anchored to the archer's hand, wrist, or arm; the archer may then situate the bowstring against the first end 36 of the jaw 14 or in the notch 30 at the first end 26 of the body 12 and then cock the release 10 to entrap or capture the bowstring against the first end 36 or within the space 66. The user can then pull his/her hand, wrist, or arm, thereby pull the release 10, proximally or rearwardly towards the archer to draw the bow. Thereafter, the user may "pull" the trigger 18 for moving the first end 36 of the jaw 14 in the direction opposite the direction 58 and release the bowstring. Non-limiting exemplary embodiments of release mounts are disclosed in Applicant's co-owned U.S. Pat. Nos. 7,320,318, 7,422,008, 7,753,043, and 7,926,476 which are herein incorporated by reference in their entirety.

In a non-limiting exemplary embodiment, the release 10 includes a back tension adjustment apparatus 78. A non-limiting exemplary embodiment of the back tension adjustment apparatus 78 is illustrated in FIGS. 1-3, 5, 9 12. In some exemplary embodiments, the back tension adjustment apparatus 78 includes a sheath 80, a tension adjustment rod 82, a tension adjustment knob 84, and a back tension biasing element 86.

In a non-limiting exemplary embodiment, the sheath 80 includes a first section 88 and a second section 90. In some exemplary embodiments, the first section 88 is defined at least in part by spaced apart opposing walls 92 and 94 having slots 96 and 98, respectively. In certain exemplary embodiments, the slots 96 and 98 are substantially aligned with each other. In some exemplary embodiments, at least a portion of the opposing walls 32 and 34 at the second end 28 of the body 12 are disposed between the opposing walls 92 and 94 of the first section 88 of the sheath 80.

In a non-limiting exemplary embodiment, the tension adjustment rod 82 includes a first section 100 and a second section 102. In some exemplary embodiments, the first section 100 of the tension adjustment rod 82 extends into at least a portion of the body 12 through an aperture 104 at the second end 28 of the body 12. In a non-limiting exemplary embodiment, a dowel or pin 106 is provided for attaching or coupling the body 12 and the tension adjustment rod 82 to each other. In some exemplary embodiments, the dowel or pin 106 extends through the first section 100 of the tension adjustment rod 82 and the opposing walls 32 and 34 at the second end 28 of the body 12. In certain exemplary embodiments, the dowel or pin 106 extends into the slots 96 and 98 in the opposing walls 92 and 94 of the first section 88 of the sheath 80. As such, the dowel or pin 106 slidingly engages the body 12 and the sheath 80 to each other. In particular, the dowel or pin 106 couples the body 12 and the back tension adjustment apparatus 78 in sliding engagement such that the back tension adjustment apparatus 78 can slide along at least a portion of the body 12 at the second end 28 thereof in the direction 108.

In certain exemplary embodiments, the second section 102 of the tension adjustment rod 82 extends into the second section 90 of the sheath 80 through an aperture 110 such that the sheath 80 and the tension adjustment rod 82 are in sliding engagement whereby the sheath 80 can slide along the second section 102 of the tension adjustment rod 82.

In a non-limiting exemplary embodiment, the tension adjustment knob 84 is coupled or attached to the second section 102 of the tension adjustment rod 82 at an end 112 thereof. In certain exemplary embodiments, the tension adjustment knob 84 is a bolt or a screw threadingly coupled or attached to the tension adjustment rod 82.

In a non-limiting exemplary embodiment, the back tension biasing element 86 is disposed about the second section 102 of the tension adjustment rod 84 within the second section 90 of the sheath 80. In some exemplary embodiments, the back tension biasing element 86 extends between the tension adjustment knob 84 and an interior end 114 of the second section 90 of the sheath 80.

In a non-limiting exemplary embodiment, the release 10 is defined at least in part by the body 12 and the back tension adjustment apparatus 78 slidably coupled to each other. In some exemplary embodiments, the body 12 and the sheath 80 of the back tension adjustment apparatus 78 are configured to slide relative to each other. In some exemplary embodiments, when the bow is held fully drawn and/or as the bow is being drawn, the sheath 80 will slide proximally, i.e., towards the archer, relative to the body 12 and/or the body 12 will slide distally, i.e., away from the archer, relative to the sheath 80.

In a non-limiting exemplary embodiment, the back tension adjustment apparatus 78 is configured for adjusting, e.g., increasing or decreasing, the amount of back tension or force required to draw and/or hold a bow at full draw. When coupled with the release 10, the back tension adjustment apparatus 78 enables an archer to apply gradual and steady back pressure to hold the bow at full draw and provides the ability to calmly "pull" or "squeeze" or "press" the trigger 18.

In a non-limiting exemplary embodiment, the amount of back tension or force required to draw and/or hold the bow at full draw and/or to expose a portion or surface 116 of the trigger 18 can be adjusted, e.g., increased or decreasing, by operating, e.g., rotating, the tension adjustment knob 84. Increasing the back tension means relatively more back tension or force is required to draw and/or hold the bow at full draw and/or to expose the portion or surface 116 of the trigger 18. Decreasing the back tension means relatively less back tension or force is required to draw and/or hold the bow at full drawn and/or to expose the portion or surface 116 of the trigger 18. In certain exemplary embodiments, operating, e.g., rotating, the tension adjustment knob 84 in a first direction increases the back tension, i.e., increases the amount of back tension or force, required to draw and/or hold the bow at full draw. In some exemplary embodiments, operating, e.g., rotating, the tension adjustment knob 84 in a second direction opposite the first direction decreases the back tension, i.e., reduces the amount of force, required to draw and/or hold the bow at full draw.

As previously described, the release 10 is defined at least in part by the body 12 and the back tension adjustment apparatus 78 slidably coupled to each other. In some exemplary embodiments, the body 12 and the sheath 80 of the back tension adjustment apparatus 78 are configured to slide relative to each other. In a non-limiting exemplary embodiment, the distance and/or the range of such relative movement or displacement is adjusted, i.e., increased or decreased, by operating, e.g., rotating, the tension adjustment knob 84. In some exemplary embodiments, operating or rotating the tension adjustment knob 84 in a first direction decreases the distance and/or the range of displacement of the body 12 and the sheath 80 relative to each other. In certain exemplary embodiments, operating or rotating the tension adjustment knob 84 in a second direction opposite the first direction increases the distance and the range of displacement of the body 12 and/or the sheath 80 relative to each other.

In a non-limiting exemplary embodiment, the tension adjustment knob 84 is used for adjusting the exposed portion or surface 116 of the trigger 18 when the bow is drawn and/or held at full draw. In certain exemplary embodiments, the exposed portion or surface 116 of the trigger 18 is the portion or surface 116 of the trigger 18 that is co-planar with the ends or tips 118 and 120 of the opposing walls 92 and 94 of the first section 88 of the sheath 80. In some exemplary embodiments, the exposed portion or surface 116 of the trigger 18 is the portion or surface 116 of the trigger 18 that is distal of or beyond the ends or tips 118 and 120 of the opposing walls 92 and 94 of the first section 88 of the sheath 80. As previously described, the body 12 and the sheath 80 of the back tension adjustment apparatus 78 are configured for sliding relative to each other. In certain exemplary embodiments, operating, e.g., rotating, the tension adjustment knob 84 in a first direction increases the back tension or the force required to expose the portion or surface 116 of the trigger when the bow is drawn and/or held at full draw. In some exemplary embodiments, operating, e.g., rotating, the tension adjustment knob 84 in a second direction opposite the first direction decreases the back tension or the force required to expose the portion or surface 116 of the trigger when the bow is drawn and/or held at full draw.

In some exemplary embodiments, rotating the tension adjustment knob 84 in a first direction moves an end 118/120 of the first section 88 of the sheath 80 away from the trigger 18. In certain exemplary embodiments, rotating the tension adjustment knob 84 in a second direction opposite the first direction moves the end 118/120 of the first section 88 of the sheath 80 towards the trigger 18.

In some exemplary embodiments, moving the end 118/120 of the first section 88 of the sheath 80 away from the trigger 18 requires less force to further retract the sheath 80. In certain exemplary embodiments, moving the end 118/120 of the first section 88 of the sheath 80 towards the trigger 18 requires more force to further retract the sheath 80.

In some exemplary embodiments, moving the sheath 80 proximally, i.e., towards the archer, relative to the body 12 and/or moving the body 12 distally, i.e., away from the archer, relative to the sheath 80 will store energy in the back tension biasing element 86. Thereafter, decreasing or removing the back tension or force will permit the sheath 80 to move distally, i.e., away from the archer, relative to the body 12 and/or move the body 12 proximally, i.e. towards the archer, relative to the sheath 80. In certain exemplary embodiments, such movement of the body 12 and/or the sheath 80 relative to each other is due to the force or energy stored in the back tension biasing element 86.

In some exemplary embodiments, rotating the tension adjustment knob 84 in a first direction increases a force required to draw a bowstring. In certain exemplary embodiments, rotating the tension adjustment knob 84 in a second direction opposite the first direction decreases the force required to draw the bowstring. In some exemplary embodiments, rotating the tension adjustment knob 84 in a first direction increases a force required to hold a bow in a fully drawn state. In certain exemplary embodiments, rotating the tension adjustment knob 84 in a second direction opposite the first direction decreases the force required to hold the bow in the fully drawn state.

In a non-limiting exemplary embodiment, operating, e.g., rotating, the tension adjustment knob 84 in a first direction compresses the back tension biasing element 86, and operating, e.g., rotating, the tension adjustment knob 84 in a second direction opposite the first direction de-compresses the back tension biasing element 86.

In some exemplary embodiments, the back tension biasing element 86 is a compression spring. In certain exemplary embodiments, the back tension biasing element 86 is an expansion spring. It should be clearly understood that there is no intent, implied or otherwise, to limit the back tension biasing element 86 to a spring. Alternate means of providing the described functionality of the back tension biasing element 86 are considered as being within the metes and bounds of this disclosure.

In a non-limiting exemplary embodiment, pulling the trigger 18, i.e., releasing the drawn bowstring from the release 10, will permit the body 12 to move proximally relative to the sheath 80 and/or permit the sheath 80 to move distally relative to the body 12.

In a non-limiting exemplary embodiment, the release 10 includes one or more slots 122 on the second section 90 of the sheath 80. In some exemplary embodiments, at least one of the one or more slots 122 is configured for viewing a position of the back tension biasing element 86 around the second section 102 of the tension adjustment rod 84 within the second section 90 of the sheath 80. In certain exemplary embodiments, the second section 90 of the sheath includes one or more marking 124. In some exemplary embodiments, the one or markings 124 are indicative of the back tension for which the release 10 is set or configured for. In certain exemplary embodiments, the one or more markings 124 are along at least one of the one or more slots 122. In some exemplary embodiments, the one or more markings 124 are on at least a portion of an outer surface 126 of the second section 90 of the sheath 80.

In a non-limiting exemplary embodiment, at least a portion of the tension adjustment knob 84 is accessible through at least one of the one or more slots 122. In some exemplary embodiments, at least a portion of an outer surface 128 of the tension adjustment knob 84 is accessible through at least one of the one or more slots 122. In certain embodiments, the archer adjusts, i.e., increases or decreases, the back tension for the release 10 by operating, e.g., rotating, the tension adjustment knob 84 through at least one of the one or more slots 122.

In some embodiments, the first end 36 of the jaw 14 and the trigger 18 are substantially coplanar. In certain embodiments, the first end 36 of the jaw 14 and the sheath 80 are substantially coplanar. In some embodiments, the first end 36 of the jaw 14, the trigger 18 and the sheath 80 are substantially coplanar. In certain embodiments, the notch 30 at the first end 26 of the body 12 and the trigger 18 are substantially coplanar. In some embodiments, the notch 30 at the first end 26 of the body 12 and the sheath 80 are substantially coplanar. In certain embodiments, the notch 30 at the first end 26 of the body 12, the trigger 18 and the sheath 80 are substantially coplanar. In certain embodiments, the first end 36 of the jaw 14, the notch 30 at the first end 26 of the body 12 and the trigger 18 are substantially coplanar. In some embodiments, the first end 36 of the jaw 14, the notch 30 at the first end 26 of the body 12 and the sheath 80 are substantially coplanar. In certain embodiments, the first end 36 of the jaw 14, the notch 30 at the first end 26 of the body 12, the trigger 18 and the sheath 80 are substantially coplanar.

In a non-limiting exemplary embodiment, the back tension adjustment apparatus 78 incudes a release mount 130 coupled with or attached to an end of the sheath 80. As previously described, the release mount 130 enables easy attachment of the bowstring release 10 to a wrist band/strap, glove, or other arm mounting means for anchoring the release 10 to an archer's hand, wrist, or arm using, for example, flexible straps. The release 10 may therefore be anchored to the archer's hand, wrist, or arm; the archer may then situate the bowstring in the notch 30 and cock the release 10 to entrap or capture the bowstring within the space 66. The user can then pull his/her hand, wrist, or arm, thereby pull the release 10, proximally or rearwardly towards the archer to draw the bow. Thereafter, the user may "pull" the trigger 18 for unblocking the notch 30 by moving the first end 36 of the jaw 14 away from the notch 30 and release the bowstring. Non-limiting exemplary embodiments of release mounts are disclosed in Applicant's co-owned U.S. Pat. Nos. 7,320,318, 7,422,008, 7,753,043, and 7,926,476 which are herein incorporated by reference in their entirety.

In view thereof, modified and/or alternate configurations of the non-limiting exemplary embodiments illustrated and described herein may become apparent or obvious to one of ordinary skill. All such variations are considered as being within the metes and bounds of the instant disclosure. For instance, while reference may have been made to particular feature(s) and/or function(s), this disclosure is considered to also encompass any and all equivalents providing functionalities similar to those described herein with reference to the accompanying drawings. Accordingly, the spirit, scope and intent of the instant disclosure embraces all variations. Consequently, the metes and bounds of the instant disclosure are defined by the appended claims and all equivalents thereof.

What is claimed is:

1. A bowstring release, comprising:

a body comprising a channel extending between a first end and a second end of the body; and spaced apart opposing walls at the second end of the body;

a jaw, comprising first and second ends; and spaced apart opposing walls at the second end of the jaw;

a trigger comprising an edge;

a first biasing element disposed between the body and the jaw; and a second biasing element disposed between the jaw and the trigger;

wherein, at least a portion of the jaw is disposed within the channel of the body;

the second end of the jaw is disposed between the opposing walls of the body;

the jaw is coupled to the body;

the trigger is disposed between and coupled to the opposing walls of the body;

the edge of the trigger and a surface of the jaw at the second end thereof are slidably engaged; and moving the jaw into the channel of the body cocks the release.

2. The release of claim 1, wherein the bowstring is released when the trigger is pulled.

3. The release of claim 1, comprising a notch at the first end of the body.

4. The release of claim 3, wherein the first end of the jaw blocks the notch while the release is cocked.

5. The release of claim 4, wherein the notch at the first end of the body and the first end of the jaw are configured for retaining a bowstring when the release is cocked.

6. The release of claim 4, wherein the first end of the jaw unblocks the notch at the first end of the body when the trigger is pulled.

7. The release of claim 1, wherein the edge of the trigger and the jaw rotate relative to each other while the release is cocked.

8. The release of claim 1, comprising a latching notch proximate the second end of the jaw.

9. The release of claim 8, wherein the release is cocked when the edge of the trigger and the latching notch engage.

10. The release of claim 9, wherein the edge of the trigger and the latching notch disengage when the trigger is pulled.

11. The release of claim 1, wherein the edge of the trigger and the jaw rotate relative to each other while the trigger is pulled.

12. The release of claim 1, comprising a back tension adjustment apparatus.

13. The release of claim 12, wherein the back tension adjustment apparatus is slidably coupled to the release.

14. The release of claim 12, wherein the back tension adjustment apparatus comprises a sheath comprising a first section defined at least in part by spaced apart opposing walls;

a slot in each opposing wall of the sheath, wherein the slots are aligned with each other; and a second section;

a tension adjustment rod comprising a first section extending into at least a portion of the body of the release; and a second section extending into the second section of the sheath;

a tension adjustment knob coupled to the tension adjustment rod; and a back tension biasing element disposed about the second section of the tension adjustment rod within the second section of the sheath, the back tension biasing element extending between an interior end of the second section of the sheath and the tension adjustment knob;

wherein, at least a portion of the body of the release is disposed between the opposing walls of the sheath;

the first section of the sheath is in sliding engagement with the body of the release; and the second section of the sheath is in sliding engagement with the second section of the tension adjustment rod.

15. The release of claim 14, wherein rotating the tension adjustment knob in a first direction increases a force required to draw a bowstring; and rotating the tension adjustment knob in a second direction opposite the first direction decreases the force required to draw the bowstring.

16. The release of claim 14, wherein rotating the tension adjustment knob in a first direction increases a force required to hold a bow in a fully drawn state; and rotating the tension adjustment knob in a second direction opposite the first direction decreases the force required to hold the bow in the fully drawn state.

17. The release of claim 14, wherein rotating the tension adjustment knob in a first direction increases a force required to expose the trigger at an end of the first section of the sheath; and rotating the tension adjustment knob in a second direction opposite the first direction decreases the force required to expose the trigger at the end of the first section of the sheath.

18. The release of claim 14, comprising one or more slots on the second section of the sheath wherein at least one of the one or more slots is configured for viewing a position of the back tension biasing element.

19. The release of claim 18, comprising one or markings along at least one of the one or more slots on the second section of the sheath, wherein the one or more markings are indicative of the back tension.

20. The release of claim 18, wherein at least a portion of the tension adjustment knob is accessible through at least one of the one or more slots on the second section of the sheath.

* * * * *